US007718330B2

(12) United States Patent
Asano et al.

(10) Patent No.: US 7,718,330 B2
(45) Date of Patent: May 18, 2010

(54) IMAGE FORMING METHOD AND AN IMAGE FORMING APPARATUS

(75) Inventors: Masao Asano, Tokyo (JP); Tomoe Kitani, Tokyo (JP)

(73) Assignee: Konica Minolta Holdings, Inc., Tokyo (JP)

( * ) Notice: Subject to any disclaimer, the term of this patent is extended or adjusted under 35 U.S.C. 154(b) by 0 days.

(21) Appl. No.: 11/247,807

(22) Filed: Oct. 11, 2005

(65) Prior Publication Data

US 2006/0029869 A1 Feb. 9, 2006

Related U.S. Application Data

(63) Continuation-in-part of application No. 10/802,470, filed on Mar. 17, 2004, now abandoned.

(30) Foreign Application Priority Data

Mar. 24, 2003 (JP) ..... 2003-080165

(51) Int. Cl.
*G03G 13/01* (2006.01)

(52) U.S. Cl. ..... 430/45.51; 430/46.1; 430/47.2; 430/107.1

(58) Field of Classification Search ..... 430/45, 430/46, 47, 107.1, 111.4, 45.1, 45.51, 46.1, 430/47.2
See application file for complete search history.

(56) References Cited

U.S. PATENT DOCUMENTS 3,717,409 A * 2/1973 Hespenheide ..... 399/359
4,910,535 A * 3/1990 Yoshino et al. ..... 347/119
5,157,483 A * 10/1992 Shoji et al. ..... 358/515
5,262,264 A * 11/1993 Shimizu et al. ..... 430/107.1
5,485,250 A * 1/1996 Kashimura et al. ..... 399/116
5,652,075 A * 7/1997 Kanbayashi et al. ..... 430/45
5,837,414 A * 11/1998 Kitani et al. ..... 430/108.1
6,160,977 A * 12/2000 Takeichi et al. ..... 399/127
6,296,980 B1 * 10/2001 Oshiba et al. ..... 430/110.3
6,972,871 B2 * 12/2005 Tsuda et al. ..... 358/1.9
2004/0190951 A1 * 9/2004 Kitani et al. ..... 399/299

FOREIGN PATENT DOCUMENTS

| | | |
|---|---|---|
| JP | 091016330 | 4/1997 |
| JP | 9319134 | 12/1997 |
| JP | 11272003 | 10/1999 |
| JP | 2002182468 | 6/2002 |

OTHER PUBLICATIONS

Japanese Office Action in JP Application No. 2572311, Publication No. 2003-80165 dated May 29, 2007.
English translation of Japanese Office Action in JP Application No. 2572311, Publication No. 2003-80165 dated May 29, 2007.

* cited by examiner

*Primary Examiner*—Janis L Dote
(74) *Attorney, Agent, or Firm*—Lucas & Mercanti, LLP

(57) ABSTRACT

An image forming method characterized in that a plurality of toner images which differ in color is formed as superposed; a plurality of the superposed toner images is simultaneously transferred onto a sheet of recording paper; the turbidity of toners of each color which form a plurality of the toner images is less than 60; and the maximum turbidity difference among said toners of each color is 5-45.

31 Claims, 3 Drawing Sheets

IMAGE FORMING METHOD AND AN IMAGE FORMING APPARATUS

This application is a continuation-in-part application of U.S. patent application Ser. No. 10/802,470, filed on Mar. 17, 2004, now abandoned.

FIELD OF THE INVENTION

The present invention relates to an image forming apparatus employed as a color copier or a color printer, and an image forming method employing the image forming apparatus.

DESCRIPTION OF RELATED ART

In recent years, there is a marked tendency in that production of color images is required for color copiers and color printers. Color image forming methods which are practically highly valuable are divided into four main systems which are commonly called a transfer drum system, an intermediate transfer system, a KNC system (a system in which multicolor superposed images are formed on an electrophotographic photoreceptor and simultaneously transferred), and a tandem system.

The KNC system (being a system in which multicolor superposed images are formed on an electrophotographic photoreceptor and simultaneously transferred) exhibits the following feature. Multicolor images are superposed on an electrophotographic photoreceptor (hereinafter also referred simply to as a photoreceptor). As a result, the use of only one photoreceptor makes it possible to constitute a downsized color image forming apparatus (Japanese Patent Publication Open to Public Inspection (hereinafter referred to as JP-A) No. 9-319134 and U.S. Pat. No. 5,837,414).

In color image formation employing this KNC system, toner images are superposed on the photoreceptor and transferred directly onto a sheet of recording paper from the photoreceptor. As a result, image problems tend to result due to differences in surface characteristics of photoreceptors and characteristics of each toner.

For example, when the surface energy of a photoreceptor is high, toner particles or toner components adhere to the photoreceptor. As a result, insufficient transfer of toner from the photoreceptor to the sheet of recording paper results, whereby image problems such as a decrease in image density or imperfect transfer tend to occur. On the other hand, when characteristics among toners of a plurality of developing agents do not match, image problems such as toner spots near characters or black spots (strawberry-shaped spots) due to transfer repellency of toner occur, whereby sharpness is degraded.

In order to improve transferability which relates to the above-mentioned "imperfect transfer" and "spots near characters", to minimize toner filming, and to minimize insufficient cleaning, techniques have been investigated in which minute particles are incorporated into the surface layer of an electrophotographic photoreceptor to result in roughness on the surface so that transferability is improved by decreasing toner adhesion onto the photoreceptor surface, and friction with a blade is decreased. For example, reported is incorporation of minute alkylsilsesquioxane resin particles (JP-A No. 5-181291). However, minute alkylsilsequioxane resin particles are hygroscopic and at a high humidity ambience, wettability of the photoreceptor surface, namely surface energy, increases. As a result, problems occur in which transferability degrades. On the other hand, in order to reduce the surface energy of a photoreceptor, an electrophotographic photoreceptor comprising fluorine resin powder is reported. However, the fluorine resin powder does not result in sufficient surface strength, and problems occur in which streaks due to scarring on the photoreceptor surface tend to result and blurred images tend to form (JP-A No. 63-56658).

On the other hand, when attention is paid to the electrophotographic processes, latent image forming systems are divided mainly into analog image formation employing a halogen lamp as a light source, and digital system image formation employing LEDs or lasers as a light source. Recently, the digital system latent image forming system has increasingly become the main stream in personal computer printers as well as in common copiers due to ease of image processing and development to composite devices.

The digital system image formation is not only used for copying but also frequently used for producing original images. As a result, a trend has surfaced in that the digital system electrophotographic image formation is required to achieve higher image quality.

For the above requirements to achieve higher image quality, investigation is being conducted in which by employing small-sized toner particles which have been subjected to shape factor control and particle size distribution, latent images on an electrophotographic photoreceptor are faithfully visualized. When such toner is applied to the image forming system utilizing the above-mentioned KNC system, toner transferability and cleaning properties are not improved as originally expected, and imperfect transfer and spots near characters tend to result.

Namely, in the image forming system utilizing the KNC system, it is desired that both characteristics of the electrophotographic photoreceptor and the developing agent are controlled so that toner transferability is improved due to integral control.

SUMMARY

An image forming method characterized in that a plurality of toner images which differ in color is formed on an electrophotographic photoreceptor via superposition; a plurality of superposed toner images is simultaneously transferred on a sheet of recording paper; turbidities of toners of each color, forming a plurality of the toner images are less than 60; and the maximum turbidity difference among the toners is 5-45.

DETAILED DESCRIPTION OF EXEMPLARY EMBODIMENTS

The present invention will now be detailed. However, the present invention is not limited thereto. Obvious variations and alternatives are also included in the present invention.

Detailed investigation was performed for transferability onto sheets of recording paper of the toner images of each color superposed on a photoreceptor in an image forming apparatus which formed color images, employing the KNC system of the present invention. As a result, it was discovered that the amount of free external additives of each color toner was closely related to toner transferability from the photoreceptor to the sheet of recording paper, whereby the present invention was achieved. Namely, by employing at least one toner which comprises free external additives in a larger amount and exhibits larger turbidity, of various color toners, toner transferability from the photoreceptor to the sheet of recording paper is markedly improved to minimize image problems such as imperfect transfer or toner spots near characters, whereby it is possible to form electrophotographic color images which exhibit excellent sharpness.

Figure 1:
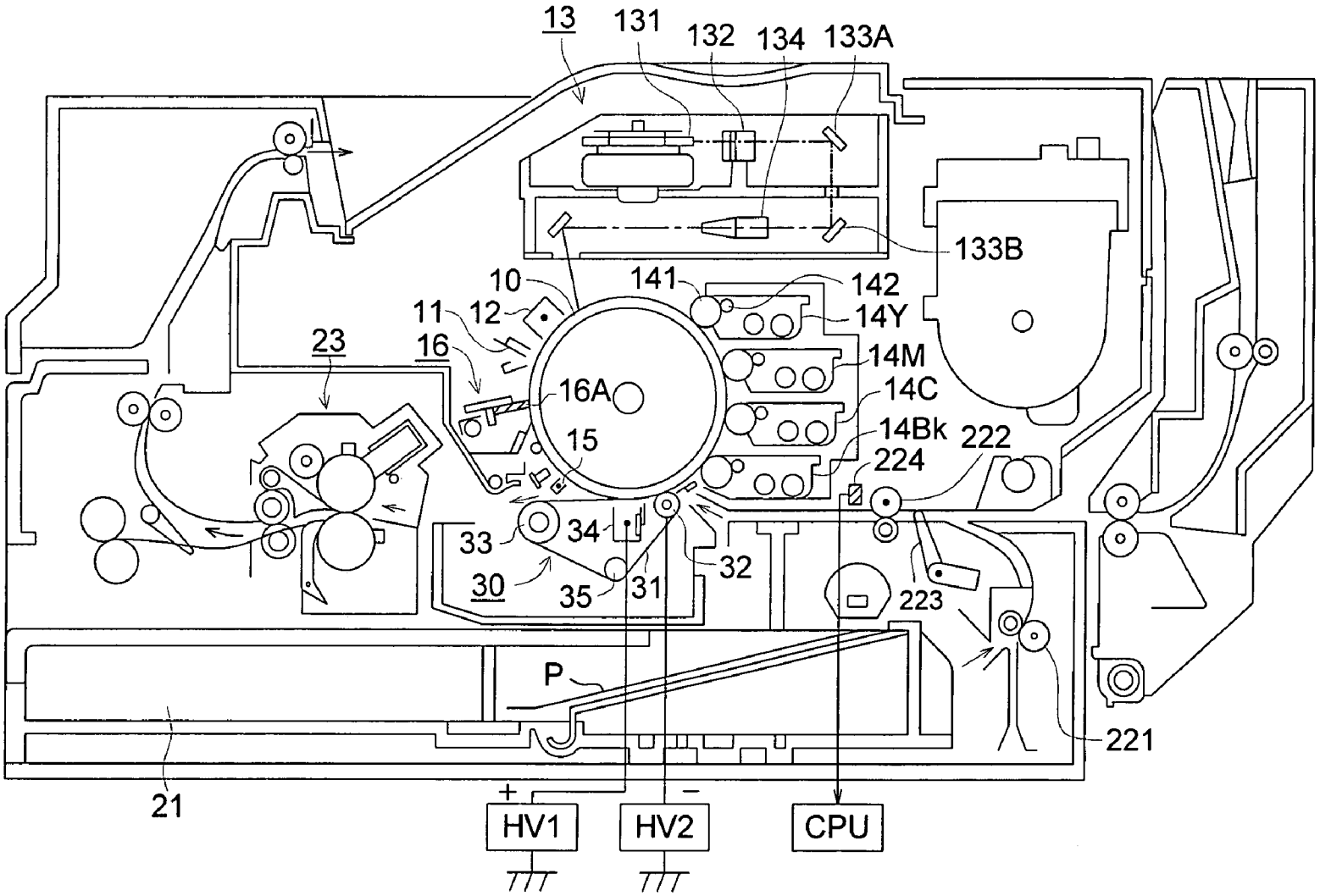
FIG. 1 is a cross-sectional view of one example of an image forming apparatus employing a multicolor toner superimposition method.

In FIG. 1, shown is a cross-sectional view of one example of an image forming apparatus employing the KNC system of the present invention. Descriptions will be made with reference to FIG. 1.

(Charging and Charge Elimination)

Electrophotographic photoreceptor (hereinafter also referred to as a photoreceptor drum) 10 comprises a drum (being a support) having thereon an organic photosensitive layer, is grounded, and is driven clockwise. Scorotron charging unit (being a charging electrode) 12 provides a uniform $V_H$ charge onto the peripheral surface of photoreceptor 10 through corona discharge formed by a grid maintained at electric potential $V_G$, and a corona discharge wire. Prior to charging by above Scorotron charging unit, in order to remove hysteresis until the preceding printing, charge on the peripheral surface of the photoreceptor is eliminated by exposure using a pre-charging lighting means (PCL) 11.

(Exposure)

After uniformly charging photoreceptor drum 10, image exposure is carried Out based on image signals, employing image exposure means 13. In image exposure means 13, light emitted from laser diodes, not shown, as a light source passes through revolving polygonal mirror 131 and collimator lens 132, deflected by reflection mirrors 133A and 133B, and passes through fθ lens 134, whereby scanning is carried out. A latent image is formed by rotation (secondary scanning) of electrophotographic photoreceptor 10. In the present example, exposure is performed for a text image, and a reversal latent image is formed so that the text image portion reaches low electric potential $V_L$.

(Development)

Around electrophotographic photoreceptor 10, arranged are development units (developing means) 14Y, 14M, 14C, and 14Bk which are loaded with a developing agent comprised of yellow (Y), magenta (M), cyan (C), or black (Bk) toner and each of the carriers. Initially, first color development is carried out employing development sleeve 141 which has a magnet in the interior and rotates while carrying the developing agent.

The developing agent is controlled to form a layer at a thickness of 300-600 μm on development sleeve 141, employing layer forming bar 142 and conveyed to a development zone.

A gap between development sleeve 141 and electrophotographic photoreceptor 10 is set at 0.4-1.0 mm which is larger than the layer thickness (of the developing agent). An AC bias of $V_{AC}$ and a DC bias of $V_{DC}$ are applied to the above gap during superposition. $V_{DC}$ and $V_H$, and charge of the toner are at the same polarity. Consequently, the toner which is allowed to release from the carrier by $V_{AC}$ does not adhere to the $V_H$ portion which is at a higher potential than $V_{DC}$, but adheres to the $V_L$ portion of which electric potential is lower than $V_{DC}$, whereby visualization (reversal development) is carried out.

After completion of the first color visualization, the image forming process of the second color starts. Uniform charging is repeated employing Scorotron charging unit 12, and a latent image based on the second color image data is formed employing image exposure means 13. During this operation, charge elimination which has been carried out in the first color image forming process, employing PCL 11, is not performed since the toner which has been allowed to adhere to the first color image portion is scattered due to a sudden decrease in the electric potential of the surroundings.

Within electrophotographic photoreceptor 10 at an electric potential of $V_H$ over the entire peripheral surface, a latent image is formed in the same manner as the first color on the portion having no prior color image and is then developed. In the portion which carries the first color image and is again developed, a latent image at $V_H'$ is formed due to light shielding by the first color adhesion toner and the charge carried by toner itself, whereby development is carried out in response to the difference in electric potential between $V_{DC}$ and $V_M'$. In the superposed portion of the first and second color images, when development is carried out while making a latent image at $V_L$, the balance between the first color and the second color is degraded. As a result, by decreasing the exposure amount for the first color, an intermediate electric potential is occasionally employed, resulting in the relationship of $V_H > V_M > V_L$.

In regard to the third and fourth colors, the same image forming processes as for the second color are carried out, and four visualized color images are formed on the peripheral surface of electrophotographic photoreceptor 10.

(Paper Feeding)

Further, recording paper P which is fed from paper feeding cassette 21 and conveyed by paired paper feeding rollers 221 and 222 is conveyed to a transfer zone by a belt transfer unit (being a transfer means) which is entrained by transfer belt 31, whereby the multicolor images on the peripheral surface of electrophotographic photoreceptor 10 are simultaneously transferred onto recording paper P. Numeral 223 is a registration shutter and 224 is a sensor which detects the passage of the leading edge of the recording paper sheet.

(Transfer)

Figure 2:
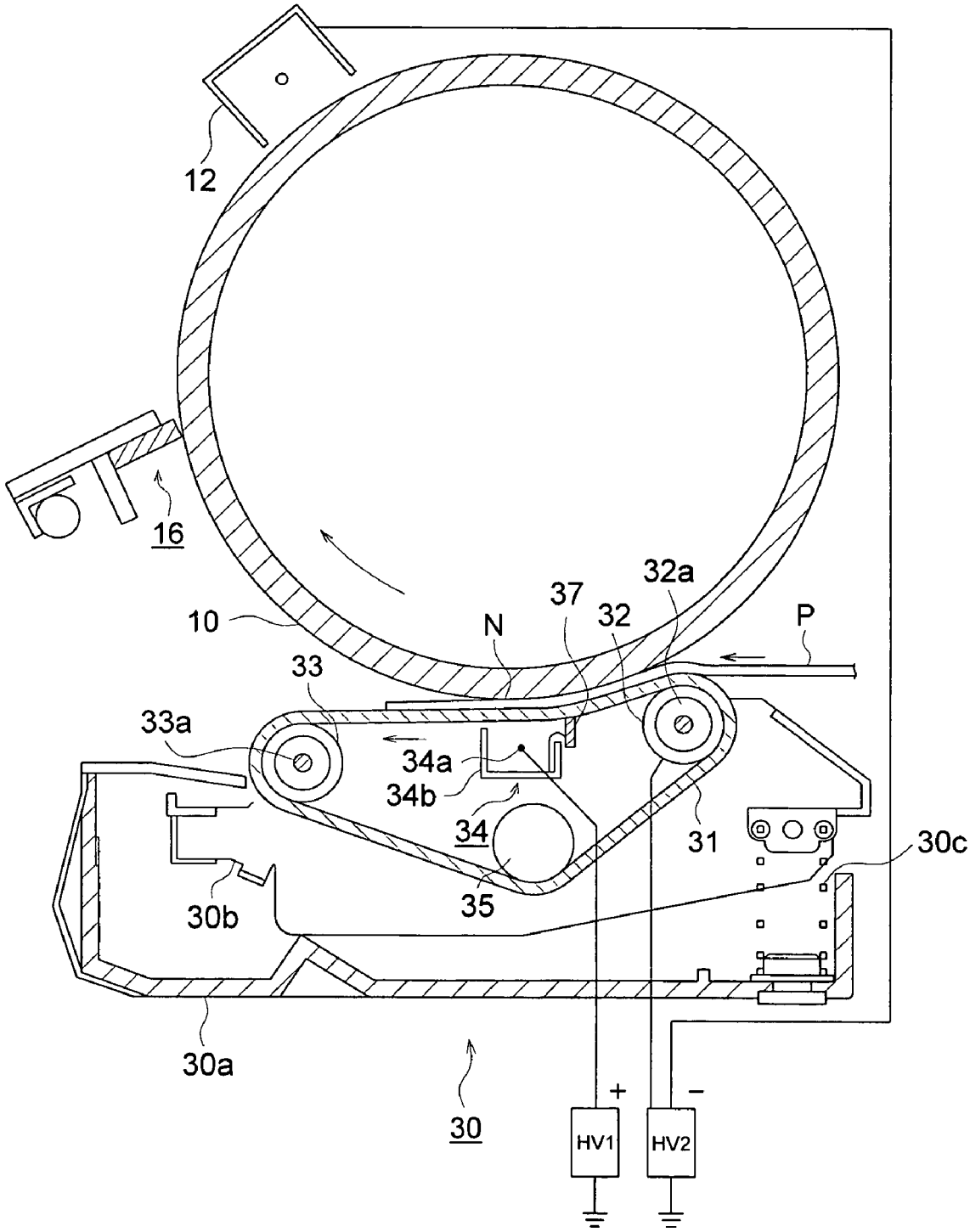
FIG. 2 is a cross-sectional view of one example of a belt transfer apparatus showing a state during transfer in which a transfer belt comes into contact with an electrophotographic photoreceptor via a sheet of recording paper.

FIG. 2 is a cross-sectional view of a belt transfer unit 30 showing the state during transfer in which transfer belt 31 comes into contact with electrophotographic photoreceptor 10 via recording paper P. Transfer belt 31 used in the transfer belt unit 30 is an endless rubber belt at a volume resistivity of $10^{10}$-$10^{11}$ Ω·cm (at 20° C. and 60% relative humidity), a thickness of 0.61 mm, and a peripheral length (diameter) of 52 cm, which is comprised of a urethane rubber substrate having thereon a FLC layer; is mounted between driving roller 33 and driven roller (being a pre-transfer roller) 32; and used at an elongation ratio of 3 percent employing tension roller 35.

Above-mentioned pre-transfer roller 32, driving roller 33, and tension roller 35 are supported by interior frame 30*b* housed within exterior frame 30*a* of belt transfer unit 30 and tensioned counterclockwise by compression spring 30*c*, utilizing shaft 33*a* of driving roller 33 as a fulcrum.

The pre-transfer roller 32 is rotated in such a manner that hitting rollers (not shown) provided at both ends of the shaft are allowed to come into contact with the non-image edge portion of the electrophotographic photoreceptor sides. The pre-transfer roller 32 is positioned so that the distance from the peripheral surface of electrophotographic photoreceptor 10 is controlled to be a specified value and revolves in accordance with the conveyance of transfer belt 31. It is designed so that a bias voltage can be applied to the pre-transfer roller 32.

On the other hand, the driving roller 33 is a roller of an outer diameter of 15.3 mm, which is connected to the power system of the main body of the apparatus and is driven counterclockwise. Since the surface is provided with an Rmax roughness of 55-85 μm, rotation is securely carried out counterclockwise without slippage against transfer belt 31 and conveyance is carried out while matching with the peripheral rate of electrophotographic photoreceptor 10.

The belt surface between pre-transfer roller 32, which is equivalent to a first electrode, and driving roller 33 of the transfer belt 31 is brought into pressure contact with the peripheral surface of electrophotographic photoreceptor 10 to form nip portion N, while on the interior side facing the above, corona discharge unit 34, which is equivalent to a second electrode, is arranged, whereby a toner image transfer zone is constituted.

The corona discharge unit is comprised of transfer wire 34*a* at a diameter of 0.08 mm made of $WO_3$ and electrode plate 34*b* made of stainless steel SUS304 which is arranged in such a manner that the distance of the side plate from transfer wire 34*a* reaches 7.5 mm, and the transfer wire 34*a* is arranged at a distance of 7 mm from the surface of electrophotographic photoreceptor 10 while facing it.

The space between the corona discharge unit 34 and pre-transfer roller 32 is partitioned employing insulating member 37, whereby it is minimized that charge formed by corona discharge unit 34 flows directly into pre-transfer roller 32. The insulating member 37 is made of a thin polyethylene terephthalate (PET) plate and is fixed to the electrode plate 34*b*.

Further, the pre-transfer roller 32 suitably presses transfer belt 31 via the top portion by setting the external diameter size of the above-mentioned hitting roller to result in a contact state in which the external peripheral of circulating transfer belt 31 does not result in excessive pressure onto the drum surface over downstream side through the gap.

Variable voltage in the range of +3.5-+7.5 kV is applied to transfer wire 34*a* of the corona discharge unit 34, employing transfer electrode power source HV1, while variable voltage VPR in the range of −1,000-−2,500 V is applied to shaft 32*a* of the pre-transfer roller 32, employing bias power source HV2.

During transfer of toner images, transfer electrode power source HV1 and bias power source HV2 are allowed to work. By making charge (+) injected from pre-transfer roller 32 to the transfer belt greater than charge (−) injected from the transfer corona discharge unit to the transfer belt, integrally, + charge is injected, whereby toner is transferred onto recording paper P. It is possible to suitably control output voltage from transfer electrode power source HV1 depending on the thickness and materials of recording paper P as well as ambient conditions. When recording paper P is not being passed, transfer electrode power source HV1 is not allowed to work and bias electrode power source HV2 is allowed to work, whereby a minus charge is integrally injected to transfer belt 31. By so doing, adhesion of unnecessary toner on image bearing body 10 to transfer belt 31 is minimized or residual toner adhered to transfer belt 31 is reversely transferred to electrophotographic photoreceptor 10, resulting in continuous cleaning of the transfer belt.

(Separation, Fixing, and Cleaning)

After recording paper P, onto which a toner image has been transferred, is subjected to charge elimination due to AC corona discharge while utilizing shaft 33*a* of the driving roller 33 downstream hanging transfer belt 31 as a facing electrode, or while being subjected to AC corona discharge, separation from transfer belt 31 is carried out. During formation of multicolor images, transfer belt 31 of the belt transfer unit 30 is set off from electrophotographic photoreceptor 10, employing shaft 33*a* of downstream driving roller 33 as a turning center.

Multicolor image bearing recording paper P which has been separated from belt transfer unit 30 is conveyed to fixing unit 23 comprised of two pressure contact rollers in which at least one houses a heater in its interior. The adhered toner is then fused under application of heat and pressure between the pressure contact rollers and is fixed onto recording paper P, which is then ejected to the exterior of the apparatus.

After the transfer, the residual toner which remains on electrophotographic photoreceptor 10 is subjected to charge elimination by charge eliminating unit 15, employing the corona discharge unit, and thereafter, the resulting toner is conveyed to cleaning unit 16, and is scraped off into cleaning unit 16 by cleaning blade 16A, comprised of rubber materials, which comes into contact with the photoreceptor. The scraped toner is discharged employing a screw and the like, and stored in a recovery receptacle. Incidentally, depending on the arrangement, it is possible to also use the charge eliminating unit 15 to eliminate charge of the recording paper which is brought into close contact with the transfer belt.

Electrophotographic photoreceptor 10 which has been subjected to removal of the residual toner employing cleaning unit 16 is subjected to exposure by PCL 11, subsequently is uniformly charged by Scorotron charging unit 12, and is prepared for the subsequent image forming cycle. During formation of multicolor images on the electrophotographic photoreceptor, cleaning blade 16A as well as transfer belt 31 is kept separate from the photoreceptor surface, and AC charge elimination by charge eliminating unit 15 is maintained being turned off.

The toner will now be described.

Toner turbidity is defined as follows and can be determined as follows.

A ratio of a diffused component to a totally transmitted component for an incident light is calculated, and a HAZE value thus obtained is caused to represent a turbidity.

The turbidity is defined to be as follows.

HAZE value=(Diffused component/Totally transmitted component)×100

Measuring method of toner turbidity;

<Preparation of Dispersions>

Toner weighing 5 g and 50 ml of 0.7% aqueous dodecylbenzenesulfonic acid sodium salt solution are put in a beaker having a capacity of 100 ml, and they are stirred by a magnetic stirrer to be diffused.

stirrer used; Model MS500D made by Yamato Scientific Co., Ltd.

Stirring conditions: 300 r.p.m., 5 minutes

<Centrifugal Separation>

An aqueous solution in which toner is diffused is subjected to centrifugal separation on a centrifugal separator, under the conditions of 292G and 10 minutes.

Centrifugal separator used: Model H-900, made by Kokusan Co., Ltd.

Rotor: PC-400 (Radius 18.1 cm)

Revolutions per minute: 1200 r.p.m. (292 G)

Time: 10 minutes

After the centrifugal separation, 40 ml of supernatant liquid is taken out. In this case, the supernatant liquid is taken out carefully by using a pipette so that sedimental toner may not be taken out. Additionally, the supernatant liquid is carefully taken out within 10 minutes after the centrifugal separation.

<Measurement of HAZE Value)

A HAZE value of the supernatant liquid is measured by using a Haze Measuring Equipment employing an integrating sphere.

Haze Measuring Equipment: Model COH-300A, made by Nippon Denshoku Industries Co., Ltd.)

Cell used: 10 mm A higher toner turbidity value implies that free minute particle components such as external additives are in a large amount.

When a group of toners is employed in which the turbidity of toners of each color employed in a plurality of development means is less than 60 and the difference in turbidity among various toners of each color is at most 5-45, transferability of superposed color toner images on the photoreceptor is markedly improved, whereby it is possible to result in more desired effects such that it is possible to markedly minimize image problems such as character spots, the imperfect transfer, and black spots, and to improve sharpness, resulting in formation of sharp and bright color images. Difference in turbidity among various toners of each color being at most 5-45, as described herein, refers to the maximum difference between two toners selected from a plurality of toners which is employed to form images in the image forming apparatus. In the case of using, for instance, yellow (Y), magenta (M), cyan (C), and black (B) toners, calculation is carried out upon combining two toners such as Y and M, Y and C, or Y and B.

Namely, by controlling the turbidity of toners of each color to less than 60, it is possible to decrease minute free particle components and to minimize scattering of the free components on the photoreceptor. As a result, formation of character black spots and a decrease in sharpness are more easily minimized. In addition, adhesion of freed components onto the photoreceptor surface is minimized and the formation of image problems such as black spots (strawberry-shaped spot image) is more easily minimized.

Further, when difference in turbidity among toners of each color is in the range of 5 to 45, it is possible to improve transferability from the photoreceptor to recording paper sheets and to minimize toner filming on the photoreceptor, the imperfect transfer, decrease in color image density, and degradation of sharpness. In addition, it is possible to make the balance control of the charge amount among toners easier and to minimize the formation of character spots and sharpness degradation.

Turbidity of toners of each color is commonly less than 60, is preferably less than 50, and is more preferably less than 40. On the other hand, maximum difference in turbidity among toners of each color is preferably 5-45, and is more preferably 10-35.

As toners of each color, it is preferable to use a group of toners consisting of a black based toner, a yellow based toner, a magenta based toner, and a cyan based toner. By employing these four color toners, it is possible to produce sharp and bright text images and color images.

Of toners of each color, the turbidity of the black toner is preferably less than 20. By controlling the turbidity of the black toner to less than 20, images mainly comprised of text tend to result in the desired sharpness.

Of toners employed to form images, it is preferable that the toner exhibiting the maximum turbidity is a yellow based toner. The yellow based toner, even though its turbidity increases, tends to rarely result in a decrease in sharpness nor in degradation of hue.

Controlling the toner turbidity to less than 60 based on the definition and measurement method, as well as controlling the maximum difference in turbidity among various toners to 5-45, can be carried out by selecting the types of external additive particles adhered to the toner surface and the magnitude of adhesion of the above external additive particles (hereinafter also referred to simply as external additives) onto the toner surface.

The number average particle diameter of employed external additives is preferably 0.05-0.5 μm.

By accepting the particle diameter in the above range, physical adhesion force between the toner and the photoreceptor is weakened to result in desired transferability. Consequently, the resulting image density is improved. In addition, external additives once adhered are prevented from being easily released and freed due to stress such as agitation in the development unit, whereby it is possible to avoid accumulation of freed particles in the development unit. As a result, it is possible to minimize re-aggregation in the development unit and minimize imperfect transfer. In addition, since it is possible to minimize adhesion of freed components onto the photoreceptor surface, it is possible to also minimize filming onto the photoreceptor surface.

The added amount of external additives to the toner is preferably 0.05-5.0 parts by weight (hereinafter, "parts" is "parts by weight", unless otherwise noted) with respect to 100 parts of the colored particles (being the toner prior to the addition of external additives), and is more preferably 1.0-4.0 parts.

In the case of incorporation of external additives in the above-mentioned range, physical adhesion force is effectively reduced, whereby desired transferability tends to be realized. Further, external additives in an optimal amount are readily present on the toner surface, whereby the resulting external additives tend to not be easily released under the presence of stress such as agitation in the development unit. Further, the freed components are not accumulated in the development unit, are rarely re-aggregated to form nuclei in the development unit, whereby the imperfect transfer rarely results during transfer. Further, since it is possible to decrease the adhered amount of the freed components onto the photoreceptor surface, toner filming onto the photoreceptor surface tends to hardly result.

Methods to control the adhesion state of the external additives onto the colored toner are not limited, and it is possible to use any of the generally employed devices for external addition and the devices which result in fixing or deposition on the toner surface.

Employed as specific devices for fixing external additives may be a HENSCHEL MIXER, a, REDIGE MIXER, or a turbo sphere mixer. Of these, the HENSCHEL MIXER is suitably employed, since it makes it possible to achieve mixing and fixing of external additives in the same device, stirring and mixing are easily carried out and heating from the exterior is also easily performed.

As a mixing method during the above-mentioned fixing treatment, it is preferable to carry out the treatment so that the peripheral speed of the end of the stirring blades is preferably 5-50 m/second and more preferably 10-40 m/second. Further, it is preferable that preliminary mixing is carried out so that external additives are allowed tome to uniformly adhere to the surface of resinous particles. As a temperature control method, it is preferable that temperature is adjusted to the desired value while heated from the exterior employing warm water.

A temperature measurement method is such that while toner is being stirred and mixed, temperature in the toner flowing position is determined. Further, it is preferable that after the fixing treatment, a cooling process under cooled flowing water and also a crushing process are performed.

A method to control the degree of fixing of external additives onto the surface of colored particles follows. Under the temperature condition of Tg−20≦(stirring and mixing temperature)≦Tg+20, colored particles and external additives are stirred and mixed, and it is possible to allow external additive particles to adhere onto the surface of colored particles while providing mechanical impact through adjustment over an optional period.

Tg, as described herein, refers to the glass transition temperature of a toner or a binding resin constituting the toner. The glass transition temperature is determined employing a DSC7 differential scanning calorimeter (manufactured by Perkin-Elmer Corp.). The measurement method is one in which temperature is raised from 0° C. to 200° C. at a rate of 10° C./minute, and subsequently, the temperature is lowered from 200° C. to 0° C. at a rate of 10° C./minute, whereby the preceding hysteresis is eliminated. Thereafter, the temperature is raised from 0° C. to 200° C., and the endothermic peak temperature of the second heating is determined and designated as Tg. In the case of the presence of a plurality of endothermic peaks, the temperature of the primary endothermic peak is designated as Tg.

The Tg of a toner or a binding resin constituting the toner is preferably 40-70° C. In this range, toner exhibits the desired storage stability, hardly results in aggregation, and exhibits the desired fixability as well as productivity.

In view of providing fluidity, after external additives are allowed to adhere and controlled, external additive may further be added. However, it is preferable that the above-mentioned turbidity of the resulting toner is in the range.

The number average particle diameter of the above-mentioned external additives was determined employing a method of transmission type electron microscope observation, and the resulting values are listed.

Compositions of the above-mentioned external additives are not particularly limited, and any of the common external additives may be employed.

For example, suitably employed as inorganic external additives are various types of inorganic oxides, nitrides, and borides. Examples include silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride, and boron nitride.

Further, the above inorganic external additives may be subjected to hydrophobic treatment, which is preferably carried out employing so-called coupling agents of various types such as titanium coupling agents, or silane coupling agents. Also preferred are those coupling agents which are subjected to hydrophobic treatment employing higher fatty acid metal salts such as aluminum stearate, zinc stearate, or calcium stearate.

In the case of using resinous external additives, the compositions are also not particularly limited. Commonly preferred are external additive particles such as vinyl based organic external additive particles, melamine-formaldehyde condensation products, polyester, polycarbonate, polyamide, or polyurethane. This reason for this is that it is possible to easily produce those, employing a production method such as an emulsion polymerization method or a suspension polymerization method.

In a histogram showing the number based particle size distribution in which when the diameter of toner particles is represented by D (μm), natural logarithm lnD is used as the abscissa and the abscissa is divided into a plurality of classes at an interval of 0.23, the preferred toner is that the sum (M) of the relative frequency ($m_1$) of toner particles included in the highest frequency class and the relative frequency ($m_2$) of toner particles included in the second highest frequency class is at least 70 percent.

By controlling the sum (M) of relative frequency ($m_1$) and relative frequency ($m_2$) to be at least 70 percent, the variance in the particle size distribution of toner particles decreases. As a result, the first and second transferability of the above-mentioned toner image is improved, whereby it is possible to retard generation of the selective development.

The above-mentioned histogram showing the number based particle size distribution is one in which natural logarithm lnD (D represents the diameter of each toner particle) is divided into a plurality of classes at an interval of 0.23 (0-0.23: 0.23-0.46: 0.46-0.69: 0.69-0.92: 0.92-1.15: 1.15-1.38: 1.38-1.61: 1.61-1.84: 1.84-2.07: 2.07-2.30: 2.30-2.53: 2.53-2.76 . . . ). The above histogram was produced in such a manner that particle size data of a sample determined, employing COULTER MULTISIZER under the conditions below, was transmitted to a computer via an I/O unit and was subjected to a particle size distribution analysis program.

(Measurement Conditions)

(1) Aperture: 100 μm (2) Sample preparation method: A surface active agent (being a neutral detergent) was added in an appropriate amount to 50-100 ml of an electrolyte (ISOTON R-11, manufactured by Coulter Scientific Japan Co.) and 10-20 mg of a measurement sample was added to the resting mixture. The resulting system was subjected to dispersion treatment for one minute employing an ultrasonic homogenizer, whereby a sample was prepared.

The particle diameter of the toner employed in the present invention is preferably 3-9 μm in terms of volume average particle diameter. By controlling the volume average particle diameter to be 3-9 μm, the amount of minute toner particles exhibiting a large adhesion force, which adhere to a photoreceptor to result in undesired filming, decreases and the transfer efficiency is enhanced to improve the halftone image quality as well as image quality of fine lines and dots. It is possible to determine the volume average particle diameter and particle size distribution of toner employing COULTER COUNTER TA-II, COULTER MULTISIZER, and SLAD 1100 (being a diffraction type particle size measurement apparatus manufactured by Shimadzu Corp.). The particle size distribution in the range of 2.0-40 μm was determined at an aperture diameter of 100 μm, employing COULTER COUNTER TA-II and COULTER MULTISIZER.

When toner particles are formed employing a polymerization method, it is possible to control the above-mentioned particle diameter depending on the concentration of coagulants, the added amount of organic solvents, the fusion time, as well as the composition of polymers themselves. When toner particles are formed employing a pulverization method, it is possible to control the particle diameter employing a classification process.

Methods for preparing the toner are not particularly limited. However, the polymerization method toner (hereinafter also referred to as the polymerization toner) is more preferred since its production method is simple and the uniformity is superior to pulverization toner.

Polymerization toner, as described herein, refers to toner prepared in such a manner that binder resins for toner are prepared and the toner particle shape is formed through polymerization of raw material monomers of binder resins employing the following chemical process, and more specifically refers to toner which is prepared through a polymerization reaction such as suspension polymerization or emulsion polymerization, and if desired, the following process which fuses particles with each other. Since the polymerization toner is produced in such a manner that after uniformly dispersing raw material monomers into a water-based system, polymerization is carried out, toner of a uniform particle size distribution and shape is prepared.

In either case, in the present invention, the pulverization method toner is not excluded in the same way as the polymerization method toner.

<<Constitution and Production Method of Toner>>

Toner may be produced by employing the most commonly employed pulverization method, namely one in which binder resins, colorants, and various additives which are incorporated, if desired, are kneaded, pulverized and classified, or may be produced in such a manner that resinous particles containing release agents and colorants are synthesized in a medium.

Listed as methods in which fusion is carried out in a water-based medium may be, for example, methods described in JP-A Nos. 63-186253, 63-282749, and 7-146583, as well as a method in which resinous particles are formed through salting-out/fusion.

The weight average diameter of resinous particles employed herein is preferably 50-2,000 nm. These resinous particles may be prepared employing any of the granulation polymerization methods such as emulsion polymerization, suspension polymerization, or seed polymerization, of which the emulsion polymerization method is preferably employed.

In any of the production methods, employed as monomers used to produce resins may be any of the conventional polymerizable monomers known in the art. Further, the monomers may be employed individually or in combinations of at least two types to satisfy the required characteristics.

Binder resins are not particularly limited, and it is possible to use commonly known binder resins such as styrene based resins, acryl based resins, styrene-acrylic resins, polyester resins, styrene-butadiene resins, or epoxy resins.

Specifically listed as monomers constituting styrene based resins, acryl based resins, and styrene-acrylic resins are styrene or styrene derivatives such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene, or p-n-dodecylstyrene; acrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, or dimethylaminoethyl methacrylate; and acrylic acid ester derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, dimethylaminoethyl acrylate, or diethylaminoethyl acrylate. These may be employed individually or in combinations.

Specifically exemplified compounds of other vinyl based polymers include olefins such as ethylene, propylene, or isobutylene; halogenated vinyls such as vinyl chloride, vinylidene chloride, vinyl bromide, vinyl fluoride, or vinyl fluoride; vinyl esters such as vinyl propionate, vinyl acetate, or vinyl benzoate; vinyl ethers such as vinyl methyl ether or vinyl ethyl ether; vinyl ketones such as vinyl methyl ketone, vinyl ethyl ketone, or vinyl hexyl ketone; N-vinyl compounds such as N-vinylcarbazole, N-vinylindole, or N-vinylpyrrolidone; vinyl compounds such as vinylnaphthalene or vinylpyridine; and acrylic acid or methacrylic acid derivatives such as acrylonitrile, methacrylonitrile, acrylamide, N-butylacrylamide, N,N-dibutylacrylamide, methacrylamide, N-butylmethacrylamide, or N-octadecylacrylamide. These vinyl based monomers may be employed individually or in combinations.

Further, listed as examples of monomers to prepare carboxylic acid-containing polymers employing styrene-acryl based resins (being vinyl based resins) are acrylic acid, methacrylic acid, α-ethylacrylic acid, fumaric acid, maleic acid, itaconic acid, cinnamic acid, maleic acid monobutyl ester, maleic acid monooctyl ester, cinnamic anhydride, and alkenylsuccinic acid methyl half ester.

Still further, added may be crosslinking agents such as divinylbenzene, ethylene glycol diacrylate, diethylene glycol diacrylate, triethylene glycol diacrylate, ethylene glycol dimethacrylate, diethylene glycol dimethacrylate, or triethylene glycol dimethacrylate.

Yet further, polyester resins include resins which are prepared in such a manner that polycarboxylic acids and polyols undergo condensation polymerization. Listed as dicarboxylic acids are maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecyl succinate, n-dodecenyl succinate, isododecyl succinate, isododecenyl succinate, n-octyl succinate, and n-octenyl succinate. Acid anhydrides of these acids may also be employed.

In addition, listed as examples of dihydric alcohols constituting polyester resins may be etherificated bisphenols such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane, ethylene glycol, diethylene glycol, triethylene glycol, 1,2-propylene glycol, 1,3-propylene glycol, 1,4-butanediol, 1,4-butenediol, neopentyl glycol, 1,5-pentaneglycol, 1,6-hexaneglycol, 1,4-cyclohexanedimethanol, dipropylene glycol, polyethylene glycol, polypropylene glycol, polytetraethylene glycol, bisphenol A, bisphenol Z, or hydrogenated bisphenol A.

Additionally, listed as those having a crosslinking structure as polyester resins are tricarboxylic acids such as 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecaroboxypropane, 1,2,4-cyclohexanetricarboxylic acid, tetra(methylenecarboxyl)methane, 1,2,7,8-octanetetracarboxylic acid, pyromellitic acid, and enpol trimer acid. It is possible to prepare crosslinked polyester resins by the addition of these acid anhydrides or polyhydric alcohol components such as sorbitol, 1,2,3,6-hexanetetrol, 1,4-sorbitan, pentaerythritol, dipentaerythritol, tripentaerythritol, 1,2,4-butanetriol, 1,2,5-pentatriol, glycerol, 2-methylpropanetriol, 2-methyl-1,2,4-butanetriol, trimethylolethane, trimethylolpropane, or 1,3,5-trihydroxymethylbenzene.

Listed as colorants employed in black based toner (hereinafter also referred to as toner Bk), yellow based toner (hereinafter also referred to as toner Y), magenta based toner (hereinafter also referred to as toner M), and cyan based toner (hereinafter also referred to as toner C) may be inorganic and organic pigments.

Employed as inorganic pigments may be those known in the art. Specific inorganic pigments are listed below.

Employed as black based pigments are, for example, carbon blacks such as furnace black, channel black, acetylene black, thermal black, or lamp black, and further magnetic powders such as magnetites or ferrites.

If desired, these inorganic pigments may be employed individually or in combinations of a plurality of those selected. Further, the added amount of pigments is commonly 2-20 percent by weight with respect to the polymers, and is preferably selected to be 3-15 percent by weight.

When employed as magnetic toner, it is possible to add the above-mentioned magnetites. In such a case, in view of providing the specified magnetic characteristics, it is preferable to add these into toner in an amount of 20-60 percent by weight.

Employed as organic pigments may also be those known in the art. Specific organic pigments are listed below.

Listed as pigments (magenta based) for magenta or red are C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, and C.I. Pigment Red 222.

Listed as pigments (yellow based) for orange or yellow are C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 93, C.I. Pigment Yellow 94, and C.I. Pigment Yellow 138.

Listed as pigments (cyan based) for green or cyan are C.I. Pigment Blue 15, C.I. Pigment Blue 15:2, C.I. Pigment Blue 15:3, C.I. Pigment Blue 16, C.I. Pigment Blue 60, and C.I. Pigment Green 7.

If desired, these organic pigments may be employed individually or in combinations of a plurality of selected ones. The added amount of pigments is commonly 2-20 percent by weight with respect to the polymers, and is preferably selected to be 3-15 percent by weight.

Colorants may be subjected to surface modification and then employed. Employed as the surface modifying agents may be those known in the art, and specifically, silane coupling agents, titanium coupling agents, and aluminum coupling agents may preferably be employed.

For the purpose of improving fluidity and enhancing cleaning properties, so-called external additives may be employed via addition. As noted above, these external additives are not particularly limited, and it is possible to use various inorganic particles, organic particles and lubricants.

Other than the above-mentioned external additive particles, slipping agents may be added to toner as an external additive. Listed as lubricants are, for example, metal salts of higher fatty acids such as zinc, aluminum, copper, magnesium, and calcium salts of stearic acid; zinc, manganese, iron, copper, and magnesium salts of oleic acid; zinc, copper, magnesium and calcium salts of palmitic acid; zinc and calcium salts of linoleic acid; as well as zinc and calcium salts of recinoleic acid.

The added amount of these lubricants is preferably 0.1-5 percent by weight with respect to the toner. In a toner preparing process, for the purpose of improving, for example, the fluidity, chargeability, and cleaning properties of toner particles prepared as above, the above-mentioned external additives may be added. Employed as methods for adding external additives may be those employing prior art mixing apparatuses such as a tubular mixer, a HENSCHEL MIXER, a, NAUTER MIXER, and a V-type mixer.

Other than binder resins and colorants, added to toner may be materials capable of providing various functions as a toner additive. Specifically listed are release agents and charge control agents.

Specifically listed as release agents may be various prior art agents such as olefin based waxes comprised of polypropylene and polyethylene and modified products thereof, natural waxes such as carnauba wax or rice wax, and amide waxes such as fatty acid bisamide. These are added in the form of release agent particles. As noted above, it is preferable that the release agent particles are subjected to salting-out/fusion with resins as well as colorants.

Employed as charge control agents may be various prior art agents which can be dispersed into water. Specifically listed are nigrosine based dyes, metal salts of naphthenic acid or higher fatty acids, alkoxylated amines, quaternary ammonium salt compounds, azo based metal complexes, and metal salts of salicylic acid or metal complexes thereof.

<<Developing Agents>>

Toner may be employed as either a single-component developing agent or a double-component one. However, the use as a double-component developing agent is preferred.

In the case of using toner as a single-component developing agent, there exists a method in which the toner is employed as a non-magnetic single-component developing agent without any modification. However, commonly, magnetic particles at a size of about 0.1-about 5 μm are incorporated into toner particles, and the resulting mixture is used as a magnetic single-component developing agent. The above incorporation is commonly carried out employing a method in which magnetic particles are incorporated into non-spherical particles in the same manner as for colorants.

Further, it is possible to use toner as a double-component developing agent upon being mixed with a carrier. In this case, employed as the magnetic particles of the carrier are prior art materials such as metals including iron, ferrites, and magneties as well as alloys of these metals with aluminum or lead. Of these, ferrite particles are particularly preferred. The volume average diameter of the above magnetic particles is preferably 15-100 μm, and is more preferably 25-60 μm.

As a representative apparatus, it is possible to measure the volume average particle diameter of the carrier, employing a laser diffraction type particle size measurement apparatus "HEROS", provided with a wet type homogenizer (manufactured by Sympatec Co.).

Preferred carriers include one in which magnetic particles are further coated with resins, as well as a so-called resin-dispersed type carrier prepared by dispersing magnetic particles into resins. Resinous compositions for coating are not particularly limited. For example, preferred are olefin based resins, styrene based resins, styrene-acryl based resins, silicone based resins, ester based resins, and fluorine-containing polymer based resins. Further, resins to constitute the resin-dispersed type carrier are also not particularly limited, and it is possible to use those known in the art such as styrene acryl resins, polyester resins, fluorine based resins, or phenol resins.

Photoreceptors will now be described.

Employed as an electrophotographic photoreceptor employed in image forming apparatuses may be either inorganic photoreceptors or organic photoreceptors. Of these, organic photoreceptors are more preferred due to the desired color sensitivity to laser beams employed for image exposure during formation of latent images, as well as for their high productivity.

Organic photoreceptors, as described herein, refer to electrophotographic photoreceptors which are constituted in such a manner that at least either a charge generating function or a charge transport function, which is essential for constituting electrophotographic photoreceptors, is exhibited by employing organic compounds, and include all prior art electrophotographic organic photoreceptors such as photoreceptors constituted employing prior art organic charge generating materials and organic charge transport materials, as well as photoreceptors constituted so that the charge generating function and charge transport function are exhibited by polymer complexes.

In an electrophotographic photoreceptor employed in an image forming apparatus, it is preferable to improve transferability of toner from the photoreceptor to a recording paper sheet in such a manner that the photoreceptor surface exhibits such physical properties to result in low surface energy. One of the means to achieve this is that the surface layer of the photoreceptor is modified to one comprised of fluorine based resinous particles and another is that surface energy reducing agents are provided onto the surface of the photoreceptor. By such means, the surface energy of the photoreceptor is lowered, whereby it is possible to improve the transferability from the photoreceptor to recording paper sheets. By simultaneously lowering the surface energy of the photoreceptor and employing a group of toners which are subjected to control of the above-mentioned toner turbidity, the transfer efficiency of toner from the photoreceptor to recording paper sheets is enhanced, whereby it is possible to produce electrophotographic color images which exhibit excellent sharpness of text as well as color images, in addition to exhibiting excellent color reproduction.

Further, by lowering the surface energy of the electrophotographic photoreceptor, it is preferable that the contact angle of the surface layer to water is controlled to be least 90 degrees. By controlling the contact angle to water to at least 90 degrees, it is possible to improve the cleaning property of toner as well as the transferability of toner from the photoreceptor to recording paper sheets.

Listed as the above-mentioned fluorine based resinous particles may be those comprised, for example, of polytetrafluoroethylene, polyvinylidene fluoride, polyethylene trifluoride chloride, polyvinyl fluoride, polyethylene tetrafluoride-perfluoroalkyl vinyl ether copolymers, polyethylene tetrafluoride-propylene hexafluoride copolymers, polyethylene-ethylene trifluoride copolymers, or polyethylene tetrafluoride-propylene hexafluoride-fluoroalkyl vinyl ether copolymers. The volume average particle diameter is preferably 0.05-10 μm, and is more preferably 0.1-5 μm. Further, the amount of fluorine based resinous particles incorporated into a photoreceptor is preferably 0.1-90 percent by weight with respect to the binder resins of the surface layer of the photoreceptor, and is more preferably 1-50 percent by weight. When the amount is at least 0.1 percent, it is possible to provide the photoreceptor with sufficient printing longevity and lubricating property, resulting in significant improvement of the primary transferability of the above-mentioned toner. As a result, a decrease in image density rarely results and imperfect transfer as well as degradation of sharpness hardly occurs. When the amount is controlled to be at most 90 percent by weight, the surface layer is more easily prepared.

The volume average diameter of the above-mentioned fluorine based resinous particles is determined employing a laser diffraction/scattering type particle size distribution measurement apparatus "LA-700" (manufactured by Horiba, Ltd.).

Further, the surface contact angle of photoreceptors is determined as follows. Under an ambience of 20° C. and relative humidity 50 percent, contact angle to pure water is determined employing a contact angle meter (Type CA-DT-A, manufactured by Kyowa Interface Science Co., Ltd.).

Surface energy reducing agents will now be described. Surface energy reducing agents, as described herein, refer to substances which adhere to the surface of electrophotographic photoreceptors and lower their surface energy, and more specifically refer to materials which adhere to the surface, and increase the surface contact angle (being a contact angle to pure water) of electrophotographic photoreceptors at an angle of at least 1 degree.

Materials for surface energy reducing agents are not particularly limited, as long as they increase the surface contact angle (being a contact angle to pure water) of electrophotographic photoreceptors at an angle of at least 1 degree. The most preferred surface energy reducing agents are fatty acid metal salts which result in a spreading property and a uniform layer forming property to the photoreceptor surface. The fatty acid metal salts are preferably metal salts of saturated or unsaturated fatty acids having at least 10 carbon atoms. Examples include aluminum stearate, indium stearate, gallium stearate, zinc stearate, lithium stearate, magnesium stearate, sodium stearate, aluminum palmitate, and aluminum oleate, of which metal stearates are more preferred.

Of the above-mentioned fatty acid metal salts, fatty acid metal salts, which exhibit high exit velocity of a flow tester, result in high cleavage, whereby it is possible to more effectively form a fatty acid metal salt layer on the surface of the above-mentioned photoreceptor. The exit velocity is preferably in the range of $1\times10^{-7}$-$1\times10^{-1}$, and is more preferably in the range of $5\times10^{-4}$-$1\times10^{-2}$. The exit velocity of the flow tester was determined employing Shimazdu Flow Tester "CFT-500" (manufactured by Shimadzu Corp.).

Methods for providing surface energy reducing agents onto the photoreceptor are not limited. For example, either method (1), in which surface energy reducing agents are mixed with a developing agent and the surface energy reducing agents are provided onto the photoreceptor via the resulting developing agent or (2), in which surface energy reducing agents are provided onto the surface of the photoreceptor employing an agent providing means, may be employed. However, in the case in which surface energy reducing agents are mixed with the developing agent, the mixing adversely affects development characteristic such as charging characteristics and fluidity of toner. As a result, sometimes, it becomes difficult to reach the sufficient mixing level. When described in terms of the relationship with toner, by mixing surface lowering agents with the developing agent, effects for minimizing the imperfect transfer and character spots tend to be markedly degraded. Due to that, a method is preferred in which the surface energy reducing agents are provided onto the surface of electrophotographic photoreceptor employing an agent providing means. It is possible to arrange the agent providing means in the appropriate position around the electrophotographic photoreceptor. In order to effectively utilize the arrangement space, the arrangement may be carried out utilizing one portion of the charging means, the development means, and the cleaning means described in FIG. 1. An example follows in which the agent providing means and the cleaning means are simultaneously employed.

Figure 3:
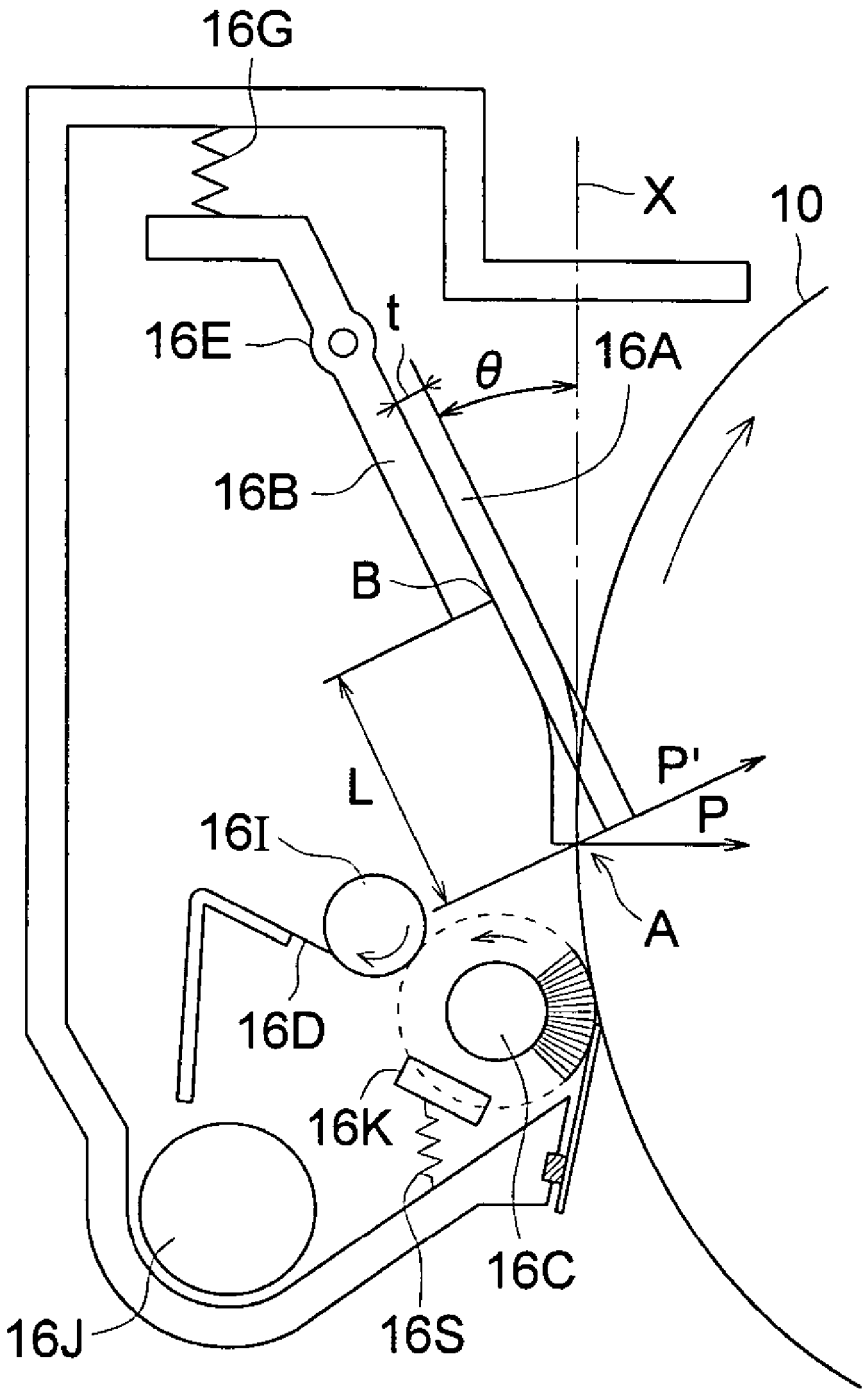
FIG. 3 is a constitution view showing one example of a cleaning means arranged in an image forming apparatus.

FIG. 3 is another constitution view of a cleaning means capable of being arranged in an image forming apparatus.

The cleaning means is employed as cleaning means 16 in FIG. 1. Cleaning blade 16A in FIG. 3 is attached to holding member 16B. An elastic rubber body is employed as the material for the cleaning blade. Known as such materials are urethane rubber, silicone rubber, fluorine rubber, chloroprene rubber, and butadiene rubber. Of these, urethane rubber is particularly preferred due to its excellent abrasion resistance compared to other kinds of rubber.

On the other hand, holding member 16B is comprised of a plate shaped metal or plastic member. Preferred as the metal member is a stainless steel plate, an aluminum plate, or a vibration damping steel plate.

The end portion of the cleaning blade, which is brought into pressure contact with a photoreceptor surface is preferably brought into pressure contact with the same in the direction opposite (being counter-direction) to the rotation of the photoreceptor under an application of load. As shown in FIG. 3, when the end portion of the cleaning blade is brought into pressure contact with the photoreceptor, it is preferable that a pressure contact plane is formed.

The preferred values of contact load P and contact angle θ of the cleaning blade to the photoreceptor are 5-40 N/m and 5-35 degrees, respectively.

Contact load P represents the vector value of pressure contact force P' in the normal direction when cleaning blade 16A is brought into contact with photoreceptor drum 10.

Contact angle θ represents the angle of tangent line X to the blade prior to blade deformation at contact point A. 16E is a rotation shaft which allows the holding member to rotate, while 16G represents a load spring.

As shown in FIG. 3, free length L of the cleaning blade represents the distance from the position of end portion B of holding member 16B to the end point of the blade prior to deformation. The preferred value of the free length L is 6-15 mm. Thickness t of the cleaning blade is preferably 0.5-10 mm. Thickness of the cleaning blade, as described herein, refers to the thickness in the perpendicular direction with respect to the adhesion plane of holding member 16B.

Employed as a cleaning means in FIG. 3 is brush roller 16C which also functions as an agent providing means. The brush roller exhibits functions for removing toner adhered onto photoreceptor 10, and recovering the toner which has been removed by cleaning blade 16A, and in addition, exhibits functions as an agent providing means which provides surface energy reducing agents to the photoreceptor. Namely, the brush roller comes into contact with photoreceptor 10, and at the contact position, rotates in the same direction as the photoreceptor, removing toner and paper dust on the photoreceptor, and simultaneously conveys the toner, removed by cleaning blade 16A to conveying screw 16J, for recovery. In this channel, it is preferable that by bringing flicker 16I as a removing means into contact with brush roller 16C, materials which have been transferred from photoreceptor 10 to brush roller 16C are removed. Further, the toner adhered onto the flicker is removed employing scraper 16D, and is conveyed to conveying screw 16J for recovery. The recovered toner is ejected to the exterior as waste or is conveyed to the development unit via a recycle pipe (not shown) for recycling toner and reused. Preferably employed as materials for flicker 16I are metal tubes made of stainless steel and aluminum. On the other hand, employed as scraper 16D are elastic plates such as a phosphor bronze plate, a polyethylene terephthalate plate, or a polycarbonate plate. It is preferable that the end is brought into contact employing a counter system which forms an acute angle with respect to the flicker rotation.

Surface energy reducing agent 16K (being a solid element comprised of zinc stearate and the like) is attached while pressed with spring load 16S. The brush rubs the surface energy reducing agent while rotating and provides the surface energy reducing agent onto the photoreceptor surface.

Employed as brush roller 16C is an electrically conductive or semi-conductive brush roller.

Employed as components for constituting the brush roller are any which are suitable. However, it is preferable to use fiber forming high-molecular weight polymers which are hydrophobic at a relatively high dielectric constant. Listed as such polymers are, for example, rayon, nylon, polycarbonate, polyester, methacrylic acid resins, acrylic acid resins, polyvinyl chloride, polyvinylidene chloride, polypropylene, polystyrene, polyvinyl acetate, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol formaldehyde resins, styrene-alkyd resins, and polyvinyl acetal (e.g. polyvinyl butyral). These binder resins may be employed individually or in combinations of at least two types. Particularly preferred are rayon, nylon, polyester, acryl resins, and polypropylene.

Further, employed as the above-mentioned brush is one which is electrically conductive or semi-conductive. It is possible to use a brush of which specific resistance is controlled to a specified value by incorporating low resistant materials such as carbon into the components.

The specific resistance of the bristles of the brush roller is preferably in the range of $10^1$-$10^6$ Ωcm when determined in such a state that at normal temperature and humidity (26° C. and 50 percent relative humidity), voltage at 500 V is applied to both ends of a 10 cm long bristle.

Namely, it is preferable that the brush roller is comprised of a core material such as stainless steel and electrically conductive or semi-conductive bristles at a specific resistance of $10^1$-$10^6$ Ωcm. By maintaining the specific resistance in this range, it is possible to minimize banding and the like due to discharge, and increase electric potential difference with the photoreceptor, whereby it is possible to maintain desirable cleaning properties.

The thickness of one bristle employed in the brush roller is preferably 5-20 denier. When the thickness is at least 5 denier, sufficient abrasion force can be applied, whereby it is possible to remove materials adhered onto the surface. When the thickness is at most 20 denier, the resulting brush exhibits suitable stiffness, whereby without scratching the photoreceptor surface, abrasive wear is minimized to extend the life of the photoreceptor.

Denier, as described herein, is the numerical value, as g (gram) unit, which is obtained by weighing a 9,000 m long bristle which constitutes the above-mentioned brush.

The bristle density (being the number of bristles per square centimeter) of the above-mentioned brush is $4.5\times10^2$–$2.0\times10^4$ per $cm^2$. By setting the density in the above range, the resulting stiffness becomes appropriate whereby it is possible to suitably control abrasion force. As a result, abrasion is uniformly carried out to make it possible to uniformly remove adhered materials and minimize abrasion and wear of the photoreceptor, whereby it is possible to minimize formation of poor images resulting in background staining due to a decrease in speed as well as black streaks due to scarring.

The penetrating length of the brush roller to the photoreceptor is preferably set at 0.4-1.5 mm, and more preferably at 0.5-1.2 mm. The above penetrating length relates to a load applied to the brush which is generated by the relative movement of the photoreceptor drum and the brush roller. When viewed from the photoreceptor drum, the above load is equivalent to abrasion force resulted by the brush. Consequently, specifying its range means that it is more suitable that a photoreceptor is abraded by suitable force.

Penetrating length, as described herein, refers to the penetrating length into the interior of the photoreceptor under the assumption that when the brush is brought into contact with the photoreceptor, bristles of the brush are not curved on the photoreceptor surface but linearly penetrate into its interior.

The photoreceptor, onto which the surface energy reducing agent is provided, results in smaller abrasion force on the photoreceptor surface to the brush. As a result, when the penetrating length is in the above-mentioned range, it is possible to minimize filming due to toner as well as paper dust on the photoreceptor surface, whereby it is possible to minimize formation of non-uniformity of images. Further, the abraded amount of the photoreceptor is reduced, whereby it is possible to minimize formation of background stain due to a decrease in speed as well as formation streaking problems of images due to scarring on the photoreceptor surface.

Mainly employed as a core of the roller are metals such as stainless steel or aluminum, as well as paper and plastics, however, they are not limited thereto.

It is preferable that the brush roller is constituted in such a manner that a brush is arranged on the surface of a cylindrical core material via an adhesion layer.

It is preferable that the contact portion of the brush roller rotates so as to move in the same direction as the photoreceptor surface. When the above contact portions are allowed to move in the same direction, it is possible to minimize stain formed on recording paper sheets as well as in the apparatus due to spilled toner which has been removed employing the brush roller when excessive toner is present on the photoreceptor surface.

In the case in which, as noted above, the photoreceptor and the brush roller move in the same direction, the ratio of the surface rate between both is preferably in the range of 1:1.1-1:2. By controlling the ratio in the above range, it is possible to maintain the desired toner removing capability of the brush roller. As a result, it is possible to minimize insufficient cleaning, as well as blade bounding and under-curl.

Incidentally, in the case of using the FIG. 3 cleaning unit, during formation of a multicolor image on the electrophotographic photoreceptor, cleaning blade 16A, brush roller 16C, and transfer belt 31 are withdrawn from the photoreceptor surface.

EXAMPLE

The specific embodiments of the present invention will now be described. However, the constitution of the present invention is not limited thereto.

Preparation of Developing Agents

Preparation of Toners and Developing Agents (Preparation of Toners 1Bk, 1Ya, 1Yb, 1M, and 1C)

Charged into 10.0 liters of pure water was 0.90 kg of sodium n-dodecylsulfate and dissolved while stirring. Gradually added to the resulting solution was 1.20 kg of REGAL 330R (carbon black prepared by Cabot Corp.). After vigorous stirring for one hour, the resulting mixture was continuously dispersed over 20 hours employing a sand grinder (being a medium type homogenizer). The resulting dispersion was designated as "Colorant Dispersion 1".

Further, a solution comprised of 0.055 kg of sodium dodecylbenzenesulfonate and 4.0 liters of ion-exchange water was designated as "Anionic Surface Active Agent Solution A".

A solution comprised of 0.014 kg of nonylphenol polyethylene oxide 10 mol addition product and 4.0 liters of ion-exchange water was designated as "Nonionic Surface Active Agent Solution B".

A solution prepared by dissolving 223.8 g of potassium persulfate in 12.0 liters of ion-exchange water was designated as "Initiator Solution C".

Charged into a 100-liter GL (glass-lining) reaction tank fitted with a thermal sensor, a cooling pipe, and a nitrogen inletting unit were 3.41 kg of a WAX emulsion (being a number average molecular weight 3,000 polypropylene emulsion at a number average primary particle diameter of 120 nm and a solid concentration of 29.9 percent), all the "Anionic surface active agent Solution A", and all the "Nonionic surface active agent Solution B", and the resulting mixture was stirred. Subsequently, added was 44.0 liters of ion-exchange water.

Subsequently, the resulting mixture was heated. When the liquid composition was heated to 75° C., all the "Initiator Solution C" was added drop by drop. Thereafter, while controlling the temperature of the liquid composition at 75±1° C., 12.1 kg of styrene, 2.88 kg of n-butyl acrylate, 1.04 kg of methacrylic acid, and 548 g of t-dodecylmercaptan were added by dripping. After dripping, the resulting mixture was heated to 80±1° C. and stirred for 6 hours while maintaining the temperature. Subsequently, the liquid composition was cooled to 40° C. or below, and stirring was terminated. The resulting composition was filtered employing a pare filter, whereby a latex was prepared which was designated as "Latex A".

Incidentally, the glass transition temperature of resinous particles in Latex A was 57° C., and its softening point was 121° C., while with regard to its molecular weight distribution, the weight average molecular weight and the weight average particle diameter were 12,700 and 120 nm, respectively.

A solution in which 0.055 kg of sodium dodecylbenzenesulfonate was dissolved in 4.0 liters of ion-exchange water was designated as "Anionic Surface Active Agent Solution D".

Further, a solution in which 0.014 kg of nonylphenol polyethylene oxide 10 mol addition product was dissolved in 4.0 liters of ion-exchange water was designated as "Nonionic Surface Active Agent Solution E".

A solution in which 200.7 kg of potassium persulfate (manufactured by Kanto Kagaku) was dissolved in 12.0 liters of ion-exchange water was designated as "Initiator Solution F".

Charged into a 100-liter GL reaction tank fitted with a thermal sensor, a cooling pipe, a nitrogen inletting unit, and a comb-shaped baffle were 3.41 kg of a WAX emulsion (being a number average molecular weight 3,000 polypropylene emulsion at a number average primary particle diameter of 120 nm and a solid concentration of 29.9 percent), all the "Anionic Surface Active Agent Solution D", and all the "Nonionic surface active Agent Solution E", and the resulting mixture was stirred.

Subsequently, charged was 44.0 liters of ion-exchange water. The resulting mixture was heated, and when the liquid composition reached 75° C., "Initiator Solution F" was added. Subsequently, a solution previously prepared by mixing 11.0 kg of styrene, 4.00 kg of n-butyl acrylate, 1.04 kg of methacrylic acid, and 9.02 g of t-dodecylmercaptan was added by dripping. After completion of the dripping, the resulting liquid composition was heated to 72±2° C., and stirred for 6 hours while maintaining the above temperature. Further, the temperature of the liquid composition was raised to 80±2° C. and stirred for 12 hours while maintaining the above temperature. Subsequently, the liquid composition was cooled to at least 40° C., and stirring was terminated. The resulting composition was filtered employing a pore filter, whereby a latex was prepared which was designated as "Latex B".

Incidentally, the glass transition temperature of resinous particles in Latex B was 58° C., and its softening point was 132° C., while with regard to its molecular weight distribution, the weight average molecular weight and the weight average particle diameter were 245,000 and 110 nm, respectively.

A solution in which 4.36 kg of sodium chloride as a salting-out agent was dissolved in 20.0 liters of ion-exchange water was designated as "Sodium Chloride Solution G".

A solution in which 1.00 g of a fluorine based nonionic surface active agent was dissolved in 1.00 liter of ion-exchange water was designated as "Nonionic Surface Active Agent Solution H".

While stirring, charged into a 100-liter SUS reaction tank fitted with a thermal sensor, a cooling pipe, a nitrogen inletting unit, and a particle diameter and shape monitoring unit were 20.0 kg of Latex A, and 5.2 kg of Latex B, prepared as above, as well as 0.4 kg of Colorant Dispersion 1 and 20.0 kg of ion-exchange water. Subsequently, the resulting mixture was heated to 40° C., and Sodium Chloride Solution G, 6.00 kg of isopropanol (manufactured by Kanto Kagaku), and Nonionic Surface Active Agent Solution H were added in the above order. Thereafter, the resulting mixture was allowed to stand for 10 minutes, and then heated to 85° C. over a period of 60 minutes. Subsequently, while maintained at 85±2° C., particles were allowed to grow while stirring for 0.5-3 hours while being subjected to salting-out/fusion (being a salting-out/fusion process). Subsequently, 2.1 liters of pure water was added to terminate the growth of the particles, whereby a fused particle dispersion was prepared.

Charged into a 5-liter reaction vessel fitted with a thermal sensor, a cooling pipe, and a particle diameter and shape monitoring unit, was 5.0 kg of the fused particle dispersion prepared as above. Subsequently, the above dispersion was stirred at 85±2° C. for 0.5-15 hours, whereby the shape was controlled (being a shape control process). Thereafter, the resulting dispersion was cooled to at most 40° C. and stirring was terminated. Subsequently, by employing a centrifuge, classification was carried out in the liquid composition employing a centrifugal sedimentation method, and filtered employing an opening 45 μm sieve. The resulting filtrate was designated as a coalescence liquid composition. Subsequently, by employing a filter, non-spherical particles were collected from the above coalescence liquid composition via filtration, and thereafter, were washed with ion-exchange water. The resulting non-spherical particles were dried at an air suction temperature of 60° C. employing a drier and subsequently dried at 60° C., employing a fluid layer drier. Added to 100 parts by weight of the resulting colored particles were 0.5 part by weight of hydrophobic silica (at a hydrophobicity of 75 and a number average primary particle diameter of 12 nm) and 0.25 part by weight of 0.05 μm titanium oxide. The resulting mixture was mixed at 52° C. for 10 minutes at a Henschel mixer peripheral rate 40 m/second, whereby "Toner 1Bk" was prepared.

"Toner 1Ya" was prepared in the same manner as Toner 1Bk, except that carbon black was replaced with C.I. Pigment Yellow 185. Further, "Toner 1Yb" was prepared while decreasing the peripheral rate of the HENSCHEL MIXER.

"Toner 1M" was prepared in the same manner as Toner 1Bk, except that carbon black was replaced with C.I. Pigment Red 122.

"Toner 1C" was prepared in the same manner as Toner 1Bk, except that carbon black was replaced with C.I. Pigment Blue 15:3. Table 1 shows measurement results of number average particle diameter and $M(m_1+m_2)$ of Toners 1Bk, 1Ya, 1M, and 1C, while Table 2 shows the measurement results of toner turbidity. Further, the number average particle diameter and $M(m_1+m_2)$ of Toner 1Yb were almost same as for Toner 1Ya.

(Preparation of Toners 2Bk, 2Ya-2Yf, 2M, and 2C)

Toners 2Bk, 2Ya-2Yf, 2M, and 2C were prepared in the same manner as above-mentioned Toners 1Bk, 1Y, 1M, and 1C, except that the hydrophobic silica (at a hydrophobicity degree of 75 and a number average primary particle diameter of 12 nm) was replaced with hydrophobic silica (at a hydrophobicity degree of 77 and a number average primary particle diameter of 20 nm), and the peripheral rate and the duration of the HENSCHEL MIXER were varied. Table 2 shows the measurement results of turbidity of Toners 2Bk, 2Ya-2Yf, 2M, and 2C. Incidentally, the number average particle diameter of $M(m_1+m_2)$ of these toners were almost the same as the measurement results (toner number average particle diameter and $M(m_1+m_2)$) of toners which correspond to each color of Toners 1Bk, 1Ya, 1M, and 1C.

(Preparation of Toners 3Bk, 3Ya-3Yd, 3M, and 3C)

Toners 3Bk, 3Ya-2Yd, 3M, and 3C were prepared in the same manner as above-mentioned Toners 1Bk, 1Y, 1M, and 1C, except that 0.5 part by weight of the hydrophobic silica (at a hydrophobicity degree of 75 and a number average primary particle diameter of 12 nm) was varied to 1.8 parts by weight, and the peripheral rate and the mixing duration of the HENSHCEL MIXER were varied. Table 2 shows the measurement results of turbidity of Toners 3Bk, 3Ya-3Yd, 3M, and 3C. Incidentally, the number average particle diameter and $M(m_1+m_2)$ of these toners were almost the same as the measurement results of toners which basically correspond to each color of Toners 1Bk, 1Ya, 1M, and 1C.

(Preparation of Toners 4Bk, 4Ya-4Yc, 4M, and 4C)

Toners 4Bk, 4Ya-4Yc, 4M, and 4C were prepared in the same manner as above-mentioned Toners 1Bk, 1Y, 1M, and 1C, except that 0.5 part by weight of the hydrophobic silica (at a degree of hydrophobicity of 75 and a number average primary particle diameter of 12 nm) was varied to 1.8 parts by weight of the hydrophobic silica (at a hydrophobicity degree of 77 and a number average primary particle diameter of 20 nm) and the peripheral rate and the mixing duration of the HENCHEL MIXER were varied. Table 2 shows the measurement results of turbidity of Toners 4Bk, 4Ya-4Yc, 4M, and 4C. Incidentally, the number average particle diameter and $M(m_1+m_2)$ of these toners were almost the same as the measurement results of toners which basically correspond to each color of Toners 1Bk, 1Ya, 1M, and 1C.

(Preparation of Toners 5Bk, 5Y, 5Ma-5Mc, and 5c)

Toners 5Bk, 5Y, 5Ma-5Mc, and 5C were prepared in the same manner as above-mentioned loners 1Bk, 1Y, 1M, and 1C, except that 0.5 part by weight of the hydrophobic silica (at a hydrophobicity degree of 75 and a number average primary particle diameter of 12 nm) was varied to 3.3 parts by weight and the peripheral rate and the mixing duration of the HENSCHEL MIXER were varied. Table 2 shows the measurement results of turbidity of Toners 5Bk, 5Y, 5Ma-5Mc, and 5C. Incidentally, the number average particle diameter and $M(m_1+m_2)$ of these toners were almost the same as the measurement results of toners which basically correspond to each color of loners 1Bk, 1Ya, 1M, and 1C.

(Preparation of Toners 6Bk, 6Y, 6M, and 6Ca-6Cc)

Toners 6Bk, 6Y, 6M, and 6Ca-6Cc were prepared in the same manner as above-mentioned loners 1Bk, 1Y, 1M, and 1C, except that the peripheral rate and the mixing duration of the HENSCHEL MIXER were varied. Table 2 shows the measurement results of turbidity of loners 6Bk, 6Y, 6M, and 6Ca-6Cc. Incidentally, the number average particle diameter and $M(m_1+m_2)$ of these toners were almost the same as the measurement results of toners which basically correspond to each color of Toners 1Bk, 1Ya, 1M, and 1C.

TABLE 1

| Toner No. | Number Average Particle Diameter of Toner Particles (μm) | M ($m_1 + m_2$) (%) |
|---|---|---|
| 1Bk | 5.6 | 80.7 |
| 1Ya | 5.7 | 78.8 |
| 1M | 5.6 | 81.3 |
| 1C | 5.6 | 80.3 |

TABLE 2

| Developing Agent Group (Toner Group) No. | Developing Agent (Bk) No. = Toner (Bk) No. | | Developing Agent (Y) No. = Toner (Y) No. | | Developing Agent (M) No. = Toner (M) No. | | Developing Agent (C) No. = Toner (C) No. | | Turbidity Difference (Maximum − Minimum) | Remarks |
|---|---|---|---|---|---|---|---|---|---|---|
| | Toner No. | Turbidity | Toner No. | Turbidity | Toner No. | Turbidity | Toner No. | Turbidity | | |
| 1 | 1Bk | 6.2 | 1Ya | 10.3 | 1M | 6.6 | 1C | 6.4 | 4.1 | *1 |
| 2 | 1Bk | 6.2 | 1Yb | 11.4 | 1M | 6.6 | 1C | 6.4 | 5.2 | *2 |
| 3 | 2Bk | 12.5 | 2Ya | 18.3 | 2M | 12.0 | 2C | 11.3 | 7.0 | *2 |
| 4 | 2Bk | 12.5 | 2Yb | 22.1 | 2M | 12.0 | 2C | 11.3 | 10.8 | *2 |
| 5 | 2Bk | 12.5 | 2Yc | 35.3 | 2M | 12.0 | 2C | 11.3 | 24.0 | *2 |
| 6 | 2Bk | 12.5 | 2Yd | 46.0 | 2M | 12.0 | 2C | 11.3 | 34.7 | *2 |
| 7 | 2Bk | 12.5 | 2Ye | 55.1 | 2M | 12.0 | 2C | 11.3 | 43.8 | *2 |
| 8 | 2Bk | 12.5 | 2Yf | 58.3 | 2M | 12.0 | 2C | 11.3 | 47.0 | *1 |
| 9 | 3Bk | 18.5 | 3Ya | 33.4 | 3M | 19.3 | 3C | 23.8 | 14.9 | *2 |
| 10 | 3Bk | 18.5 | 3Yb | 46.0 | 3M | 19.3 | 3C | 23.8 | 27.5 | *2 |
| 11 | 3Bk | 18.5 | 3Yc | 56.8 | 3M | 19.3 | 3C | 23.8 | 38.3 | *2 |
| 12 | 3Bk | 18.5 | 3Yd | 63.3 | 3M | 19.3 | 3C | 23.8 | 44.8 | *1 |
| 13 | 4Bk | 22.3 | 4Ya | 33.8 | 4M | 29.3 | 4C | 30.5 | 11.5 | *2 |
| 14 | 4Bk | 22.3 | 4Yb | 55.6 | 4M | 29.3 | 4C | 30.5 | 33.3 | *2 |
| 15 | 4Bk | 22.3 | 4Yc | 62.2 | 4M | 29.3 | 4C | 30.5 | 39.9 | *1 |
| 16 | 5Bk | 31.5 | 5Y | 35.6 | 5Ma | 33.2 | 5C | 44.7 | 13.2 | *2 |
| 17 | 5Bk | 31.5 | 5Y | 35.6 | 5Mb | 55.1 | 5C | 44.7 | 23.6 | *2 |
| 18 | 5Bk | 31.5 | 5Y | 35.6 | 5Mc | 63.3 | 5C | 44.7 | 31.8 | *1 |
| 19 | 6Bk | 6.4 | 6Y | 7.3 | 6M | 5.3 | 6Ca | 12.1 | 6.8 | *2 |
| 20 | 6Bk | 6.4 | 6Y | 7.3 | 6M | 5.3 | 6Cb | 23.4 | 18.1 | *2 |
| 21 | 6Bk | 6.4 | 6Y | 7.3 | 6M | 5.3 | 6Cc | 52.4 | 47.1 | *1 |

*1: Beyond the Present Invention

*2: Within the present Invention (Production of Developing Agents)

Developing Agents 1Bk-1C, Developing Agents 2Bk-2C, Developing Agents 3Bk-3C, Developing Agents 4Bk-4C, Developing Agents 5Bk-5C, and Developing Agents 6Bk-6C were produced by mixing 10 parts by weight of each of Toners 1Bk-1C, Toners 2Bk-2C, Developing Toners 3Bk-3C, Toners 4Bk-4C, Toners 5Bk-5C, and Toners 6Bk-6C with 100 parts by weight of 45 μm ferrite carrier coated with styrene-methacrylate copolymers.

(Preparation of Photoreceptors)

Photoreceptors employed in the examples above were prepared as described below.

Preparation of Photoreceptor 1

The interlayer liquid coating composition, described below, was prepared and applied onto a cleaned cylindrical aluminum substrate employing an dip coating method, whereby an interlayer at a dried layer thickness of 0.3 μm was formed.

| <Interlayer (UCL) Liquid Coating Composition> | |
|---|---|
| Polyamide resins (AMILAN CM-8000, manufactured by Toray Co., Ltd.) | 60 g |
| Methanol | 1600 ml |

The liquid coating composition components, described below, were mixed and the resulting mixture was dispersed for 10 hours employing a sand mill, whereby a charge generating layer liquid coating composition was prepared. The resulting liquid coating composition was applied onto the above-mentioned interlayer, employing a dip coating method, whereby a charge generating layer at a dried layer thickness of 0.2 μm was formed.

| <Charge Generating Layer (CGL) Liquid Coating Composition> | |
|---|---|
| Y type titanyl phthalocyanine (at a maximum peak angle of 27.3 at 2θ of X-ray diffraction by Cu-Kα) | 60 g |
| Silicone resin solution (KR5240, 15% xylene-butanol solution, manufactured by Shin-Etsu Chemical Co., Ltd. | 700 g |
| 2-Butanone | 2000 ml |

The liquid coating composition components, described below, were mixed and dissolved, whereby a charge transport layer liquid coating composition was prepared. The resulting liquid coating composition was applied onto the above-mentioned charge generating layer, employing a dip coating method, whereby, a charge transports layer at a layer thickness of 20 μm was formed.

| (Charge Transport Layer (CTL) Liquid Coating Composition> | |
|---|---|
| Charge transport material (4-methoxy-4'-(4-methyl-α-phenylstyryl)triphenylamine | 200 g |
| Bisphenol Z type polycarbonate (Upiron Z300, Mitsubishi Gas Chemical Co., Inc.) | 300 g |
| Hindered amine (Sanol LS2626, manufactured by SANKYO Co., Ltd.) | 3 g |
| 1,2-Dichloroethane | 2000 ml |

Preparation of Photoreceptor 2

Photoreceptor 2 was prepared in the same manner as Photoreceptor 1 until coating of the charge transport layer.

<Surface Protective Layer>

| <Surface Protective Layer> | |
|---|---|
| Charge transport material (4-methoxy-4'-(4-methyl-α-phenylstyryl)triphenylamine | 200 g |
| Bisphenol Z type polycarbonate (UPIRON Z300, Mitsubishi Gas Chemical Co., Inc.) | 300 g |
| Hindered amine (SANOL LS2626, manufactured by SANKYO Co., Ltd.) | 3 g |
| Colloidal silica (30% methanol solution) | 8 g |
| Polytetrafluoroethylene resinous particles (at an average particle diameter of 0.5 μm) | 100 g |
| 1-Butanol | 50 g |

were mixed and dissolved, whereby a surface protective layer liquid coating composition was prepared. The resulting liquid coating composition was applied onto the above-mentioned charge transport layer, employing a dip coating method and the resulting coating was subjected to thermal curing at 100° C. for 40 minutes, whereby a protective layer at a dried layer thickness of 4 μm was formed. Photoreceptor 2 was thus prepared.

Example 1

Example Employing Photoreceptor 2 Comprising Fluorine Based Resinous Particles in the Surface Layer <Evaluation>

In each of the examples and comparative examples, the color digital copier, described in FIG. 1, which comprised each of the development means of Y (yellow), magenta (M), C (cyan), and Bk (black), was loaded with a developing agent group (a toner group) under the combinations shown in Table 2. At normal temperature and normal humidity (20° C. and 50 percent relative humidity), 10,000 sheets were printed while employing, as an original image document, a A4 size image comprised of a white portion, Bk, Y, M, and C solid image portions, a text image portion, and a halftone image portion, and then evaluated. Evaluation items, evaluation methods, and evaluation criteria are described below.

Toner Dots Near Characters

A text image was formed of which toner dots near characters were observed directly and through the use of a hand magnifying lens at a magnification factor of 20 and evaluated based on the criteria below.

A: no toner dots near characters were noted through the use of hand magnifying lens (rated as good)

B: toner dots near characters were not noted directly but noted through the use of a hand magnifying lens (rated as commercially viable)

C: toner dots near characters were noted directly, and sharpness of characters were degraded (rated as commercially unviable)

Imperfect Transfer

A halftone image at a density of 0.4 was formed on both sides of a transfer paper sheet (at a basic weight of 200 g/m$^2$), and white spots due to imperfect transfer were visually evaluated.

A: no imperfect transfer was noted (rated as excellent)

B: 1-2 white spots due to imperfect transfer were noted only on the reverse side of the images of 100 sheets (rated as good)

C: 1-4 white spots due to imperfect transfer were noted on images of 50 sheets, however white spots were noticeable only when carefully observed (rated as commercially viable)

D: at least 5 white spots were noted on images of 50 sheets irrespective of the obverse or reverse side (rated as commercially unviable)

Black Spots

The number of black spots (strawberry-shaped spot images) on the halftone image per A4 size of which cycle matched that of the photoreceptor was recorded.

A: black spots of at least 0.4 mm were at most 3 per A4 sheet in all the copied images (rated as good)

B: in one or more sheets, 4-15 black spots of at least 0.4 mm were formed per A4 sheet (rated as commercially viable)

C: in one or more sheets, at least 16 black spots of al least 0.4 mm were formed per A4 sheet (rated as commercially unviable)

Image Density

Image density was determined as follows. The relative reflection density of the solid image portion of each color was measured employing a densitometer "RD-918" (manufactured by Macbeth Corp.) while using the density of an unprinted recording paper sheet as zero.

A: density of each of the Bk, Y, M, and C solid image portions was at least 1.2 (rated as good)

B: density of each of the Bk, Y, M, and C solid image portions was at least 0.8 (rated as commercially viable)

C: density of each of the Bk, Y, M, and C solid image portions was less than 0.8 (rated as commercially unviable)

(Sharpness)

Image sharpness was evaluated as follows. At an ambience of low temperature and low humidity (10° C. and 20 percent relative humidity) as well as high temperature and high humidity (30° C. and 80 percent relative humidity), images were printed and lack of character detail was evaluated. Text images of 3-point and 5-point were printed, and evaluation was carried out based on the criteria below.

A: images of 3-point and 5-point were clear which were easily readable

B: images of 3-point were partly not readable, while images of 5-point were clear and easily readable C: image of 3-point were hardly readable, while images of 5-point were partly or wholly not readable Process Conditions of KNC System Digital Copier Image forming line speed L/S: 160 mm/second Charging conditions of Photoreceptor (180 mmϕ): Photoreceptor surface potential in the development section was −750 V.

Image exposure light: semiconductor laser (wavelength: 780 nm)

Development Conditions (Non-Contact Development)

DC bias: −650 V

AC bias: Vp-p was 1.8 kV while the frequency was 8 kHz.

Dsd (closest distance between the photoreceptor and the development sleeve): 500 μm Controlled pressing force: 10 gf/mm Pressing control stick: SUS416 (comprised of magnetic stainless steel) of a diameter of 3 mm Development sleeve: at a diameter of 20 mm Thickness of the developing agent layer: 150 μm Transfer Conditions (Described Employing the Codes in FIG. 2)

Transfer belt 31 is made of urethane rubber at a thickness of 0.61 mm, a peripheral length ϕ of 52 mm, an elongation ratio of 3 percent during use, and a volume resistivity of $10^{10}$-$10^{11}$ Ω·cm (20° C. and 60 percent relative humidity).

Pre-transfer roller (first electrode) 32 comprises hitting rollers at both ends and controls the distance between transfer belt 31 and image holding body 10, to which it is possible to apply a bias voltage.

Corona discharge unit (second electrode) 34: The distance between the discharge wire and the side plate is 7.5 mm; the distance between the discharge wire and image carrying body 10 is 7.0 mm; and the diameter of the discharge wire is 0.08 mm. The material of discharge wire is $WO_3$ and the material of the electrode plate is SUS304.

Driving roller 33: The outer diameter is 15.3 mm, while surface roughness Rmax. is 55-85 μm.

Transfer electric current power source HV1: +3.5 to +7.5 kV

Bias power source HV2 for pre-transfer roller 32: −1,000 to −2,500 V

Cleaning Conditions of Photoreceptors

Cleaning blade: A urethane rubber blade is brought into contact with the photoreceptor in the same rotational direction employing a counter system.

Table 3 shows the results.

TABLE 3

| Developing Agent Group (Toner Group) No. | Toner Dots near Characters | Imperfect Transfer | Black Spots | Image Density | Sharpness | Remarks |
|---|---|---|---|---|---|---|
| 1 | B | D | B | C | C | *1 |
| 2 | A | C | B | B | B | *2 |
| 3 | A | C | A | B | A | *2 |
| 4 | A | A | A | A | A | *2 |
| 5 | A | A | A | A | A | *2 |
| 6 | A | A | B | A | A | *2 |
| 7 | A | B | B | A | B | *2 |
| 8 | C | C | B | B | C | *1 |
| 9 | A | B | A | A | A | *2 |
| 10 | A | B | B | A | A | *2 |
| 11 | A | B | B | A | B | *2 |
| 12 | B | C | C | B | C | *1 |
| 13 | B | B | A | A | A | *2 |
| 14 | B | B | B | A | A | *2 |
| 15 | C | C | C | B | C | *1 |
| 16 | B | B | B | A | A | *2 |
| 17 | B | B | B | A | A | *2 |
| 18 | C | C | C | C | C | *1 |
| 19 | A | C | B | B | B | *2 |
| 20 | A | B | A | A | A | *2 |
| 21 | C | D | B | B | C | *1 |

*1; Beyond the Present Invention
*2; Within the present Invention

As can be seen from Table 3, developing agent groups which satisfied the requirements for the present invention, namely developing agent groups (Nos. 2, 3, 4, 5, 6, 7, 9, 10, 11, 13, 14, 16, 17, 19, and 20) in which the maximum turbidity difference of toners of each color was in the range of 5-45, resulted in commercially viable evaluation for toner dots near character, imperfect transfer, black spots, image density, and sharpness. On the other hand, in developing agent groups (Nos. 1, 8, 12, 15, 18, and 21), the following problems occurred. In No. 1 in which the turbidity difference among the toners of each color was 4.1, the fluidity of the toner was insufficient, whereby the transferability, image density, and sharpness were degraded. In No. 21, in which the turbidity difference was 47, toner dots near characters (toner dots near colored characters) increased due to instability of the balance of the charge amount, resulting in degradation of sharpness. In No. 21, imperfect transfer also resulted. In developing agent groups (Nos. 12, 15, and 18), in which the turbidity of any of the toners of each color was at least 60, the amount of free external additives increased excessively, whereby many black spots were formed and the sharpness was degraded. Further, of the developing agent groups which satisfied the requirements of the present invention, developing agent groups (Nos. 4, 5, 6, 10, and 20) in which the maximum turbidity difference among toners of each color was 10-35 and the turbidity of the black toner was less than 20, resulted in marked improved effects.

Example 2

Example in which Photoreceptor 1 was Employed and Surface Energy Reducing Agents were Provided The photoreceptor cleaning unit under the conditions of the KNC system digital copier of the above-mentioned Example 1 was replaced with a cleaning means, shown in FIG. 3, having a brush roller which simultaneously functioned as an agent providing means, and zinc stearate as a surface energy reducing agent was positioned at 16K in FIG. 3. While supplying zinc stearate to the photoreceptor surface via the brush roller, evaluation was performed in the same manner as for Example 1, employing the developing agent groups (toner group) shown in Table 2. Evaluations items, evaluation methods, and evaluation criteria were the same as for Example 1.

Cleaning Conditions of the Cleaning Means having a Agent Providing Means

Cleaning blade: A urethane rubber blade was brought into contact with the photoreceptor in the same rotational direction employing a counter system.

The cleaning brush was made of electrically conductive acrylic resins at a brush bristle density of $3\times10^3/cm^3$, and the penetration length was set at 1.0 mm.

Evaluation was carried out under the above conditions. As a result, evaluation results almost similar to Example 1 were obtained. Namely, even though the surface layer of the photoreceptor did not comprise fluorine based resinous particles, by supplying the surface energy reducing agent onto the photoreceptor surface, effects similar to Example 1 were obtained.

Example 3

An Example in which the Toner Particle Size Distribution was Varied (Preparation of Toners 7Bk, 7Y, 7M, and 7C)

Toners 7Bk, 7Y, 7M, and 7C were prepared in the same manner as the Toners 2Bk, 2Yb, 2M, and 2C, except that classification level in the liquid composition, employing a centrifugal sedimentation method was varied and $M(m_1+m_2)$ was also varied. Table 4 shows the number average particle diameter, $M(m_1+m_2)$, and the turbidity of Toners 7Bk, 7Y, 7M, and 7C.

Developing Agent Group 22, consisting of Developing Agents 7Bk, 7Y, 7M, and 7C for evaluation, was prepared by blending 10 parts by weight of each of these toners with 100 parts by weight of a ferrite carrier coated with styrene-methacrylate copolymers.

(Preparation of Toners 8Bk, 8Y, 8M, and 8C)

Toners 8Bk, 8Y, 8M, and 8C were prepared in the same manner as the Toners 2Bk, 2Yb, 2M, and 2C, except that classification level in the liquid composition, employing the centrifugal sedimentation method was varied and $M(m_1+m_2)$ was also varied. Table 4 shows the number average particle diameter, $M(m_1+m_2)$, and the turbidity of Toners 8Bk, 8Y, 8M, and 8C.

Developing Agent Group 23, consisting of Developing Agents 8Bk, 8Y, 8M, and 8C for evaluation, was prepared by blending 10 parts by weight of each of these toners with 100 parts by weight of a ferrite carrier coated with styrene-methacrylate copolymers.

TABLE 4

| Toner No. | Number Average Particle Diameter of Toner Particles (μm) | M $(m_1 + m_2)$ (%) | Turbidity | Turbidity Difference (maximum − minimum) |
|---|---|---|---|---|
| 7Bk | 5.4 | 71.5 | 14.6 | 11.2 |
| 7Y | 5.5 | 72.3 | 25.6 | |
| 7M | 5.4 | 71.1 | 14.4 | |
| 7C | 5.4 | 72.1 | 15.7 | |
| 8Bk | 5.7 | 68.3 | 21.5 | 15.7 |
| 8Y | 5.8 | 68.5 | 37.2 | |
| 8M | 5.7 | 67.8 | 23.3 | |
| 8C | 5.7 | 68.8 | 23.6 | |

Evaluation was carried out in the same manner as Example 1, except that Developing Agents Groups 22 and 23 were employed instead of Developing Agent Group 4 (Toners 2Bk, 2Yb, 2M, and 2C). Table 5 shows the results.

TABLE 5

| Developing Agent Group (Toner Group) No. | Toner Dots near Characters | Imperfect Transfer | Black Spots | Image Density | Sharpness |
|---|---|---|---|---|---|
| 22 | A | B | A | A | A |
| 23 | B | C | B | A | B |

As can be seen from Table 5, Developing Agent Group 22, in which the sum (M) of relative frequencies of the above-mentioned toner particles was at least 70 percent, resulted in more improvement for evaluated items than Developing Agent Group 23, in which (M) was less than 70 percent.

According to the embodiments of the present invention, it is possible to provide excellent electrophotographic images employing an image forming apparatus utilizing the KNC system. Namely, as can be seen from the above-mentioned examples, it is possible to provide an electrophotographic image forming apparatus and method which are capable of achieving improved toner transfer characteristics of the KNC system, minimizing image problems such as the imperfect transfer generated by a decrease in toner transfer, or toner dots near characters, and forming color images at the desired density and sharpness.

What is claimed is:

1. An image forming method comprising:

forming a superposed toner image on an electrophotographic photoreceptor of an image forming apparatus, the image forming apparatus having a plurality of developing devices including a yellow developing device containing a yellow based toner, a magenta developing device containing a magenta based toner, a cyan developing device containing a cyan based toner and a black developing device containing a black based toner, the superposed toner image comprising a yellow toner image including the yellow based toner, a magenta toner image including the magenta based toner, a cyan toner image including the cyan based toner and a black toner image including the black based toner, one superposed upon another; and transferring the superposed toner image simultaneously onto a recording paper, wherein each of the yellow based toner, the magenta based toner, the cyan based toner and the black based toner has a turbidity of less than 60, and the maximum turbidity difference among the yellow based toner, the magenta based toner, the cyan based toner and the black based toner is 5-45.

2. The image forming method in claim 1 wherein the electrophotographic photoreceptor comprises a surface layer comprising fluorine based resinous particles.

3. The image forming method in claim 2 wherein the ratio of the fluorine based resin particles to a binder resin of the surface layer of the electrophotographic photoreceptor is 0.1-90 percent by weight.

4. The image forming method in claim 1 comprising supplying a surface energy reducing agent on the surface of the electrophotographic photoreceptor.

5. The image forming method in claim 4 wherein said surface energy reducing agent is a fatty acid metal salt.

6. The image forming method in claim 5 wherein the electrophotographic photoreceptor comprises a surface layer comprising fluorine based resinous particles.

7. The image forming method in claim 1 wherein the black based toner has a turbidity of less than 20.

8. The image forming method in claim 1 wherein the turbidity of each of the yellow based toner, the magenta based toner, the cyan based toner and the black based toner is less than 50.

9. The image forming method in claim 8 wherein the maximum turbidity difference among the yellow based toner, the magenta based toner, the cyan based toner and the black based toner is 10-35.

10. The image forming method in claim 1 wherein the turbidity of each of the yellow based toner, the magenta based toner, the cyan based toner and the black based toner turbidities of the toners is less than 40.

11. The image forming method in claim 1 wherein the volume average particle diameter of each of the yellow based toner, the magenta based toner, the cyan based toner and the black based toner is 3-9 μm.

12. The image forming method in claim 1 comprising supplying at least one of aluminum stearate, indium stearate, gallium stearate, lithium stearate, magnesium stearate, sodium stearate, aluminum palmitate, or aluminum oleate on the surface of the electrophotographic photoreceptor.

13. The image forming method in claim 1 wherein at least one of the yellow based toner, the magenta based toner, the cyan based toner and the black based toner comprises an external additive at a number average particle diameter of 0.05-0.5 μm.

14. The image forming method in claim 1 wherein the contact angle of the surface layer of the electrophotographic photoreceptor to water is at least 90 degrees.

15. The image forming method of claim 1, wherein the sum (M) of the relative frequency ($m_1$) of toner particles included in the highest frequency class and the relative frequency ($m_2$) of toner particles included in the second highest frequency class of at least one of the yellow based toner, the magenta based toner, the cyan based toner and the black based toner is at least 70 percent in a histogram showing the number based particle size distribution in which when the diameter of toner particles is represented by D (μm), natural logarithm 1nD is taken as an abscissa and the abscissa is divided into a plurality of classes at an interval of 0.23.

16. The image forming method in claim 15 wherein the electrophotographic photoreceptor comprises a surface layer comprising fluorine based resinous particles.

17. The image forming method in claim 16 wherein the amount of the fluorine based resinous particles is 0.1-90 percent by weight with respect to a binder resin of the surface layer of the electrophotographic photoreceptor.

18. The image forming method in claim 15 comprising applying a surface energy reducing agent on the surface of the electrophotographic photoreceptor.

19. The image forming method in claim 18 wherein the surface energy reducing agent is a fatty acid metal salt.

20. The image forming method in claim 19 wherein the electrophotographic photoreceptor comprises a surface layer comprising fluorine based resinous particles.

21. The image forming method in claim 15 wherein the turbidity of the black based toner is less than 20.

22. The image forming method in claim 15 wherein the turbidity of each of the yellow based toner, the magenta based toner, the cyan based toner and the black based toner is less than 50.

23. The image forming method in claim 22 wherein the maximum turbidity difference the yellow based toner, the magenta based toner, the cyan based toner and the black based toner is 10-35.

24. The image forming method in claim 15 wherein the turbidity of each of the yellow based toner, the magenta based toner, the cyan based toner and the black based toner is less than 40.

25. The image forming method in claim 19 wherein at least one of aluminum stearate, indium stearate, gallium stearate, lithium stearate, magnesium stearate, sodium stearate, aluminum palmitate, or aluminum oleate is supplied onto the surface of said electrophotographic photoreceptor.

26. The image forming method in claim 15 wherein at least one of the yellow based toner, the magenta based toner, the cyan based toner and the black based toner comprises an external additive at a number average particle diameter of 0.05-0.5 μm.

27. The image forming method in claim 15 wherein the particle diameter of each of the yellow based toner, the magenta based toner, the cyan based toner and the black based toner is 3-9 μm in terms of volume average particle diameter.

28. The image forming method in claim 15 wherein the contact angle of the surface layer of the electrophotographic photoreceptor to water is at least 90 degrees.

29. The image forming method in claim 1 wherein the maximum turbidity difference among the yellow based toner, the magenta based toner, the cyan based toner and the black based toner is 10-35.

30. The image forming method in claim 15 wherein the maximum turbidity difference among the yellow based toner, the magenta based toner, the cyan based toner and the black based toner is 10-35.

31. The image forming method of claim 1 wherein the yellow based toner has the maximum turbidity among the yellow based toner, the magenta based toner, the cyan based toner and the black based toner.

* * * * *